US008366532B1

(12) United States Patent
Nicely

(10) Patent No.: US 8,366,532 B1
(45) Date of Patent: Feb. 5, 2013

(54) GAMING SYSTEM, GAMING DEVICE, AND METHOD PROVIDING AN OBSTACLE BOARD SLOT GAME

(75) Inventor: Mark C. Nicely, Daly City, CA (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/238,759

(22) Filed: Sep. 21, 2011

(51) Int. Cl.
*A63F 9/24* (2006.01)

(52) U.S. Cl. ..... 463/16; 463/20; 463/25; 463/31

(58) Field of Classification Search ..... 463/16–20, 463/25–29, 31
See application file for complete search history.

(56) References Cited

U.S. PATENT DOCUMENTS

| | | | |
|---|---|---|---|
| 2,743,108 | A | 4/1956 | Sanders |
| 3,853,324 | A | 12/1974 | Reiner et al. |
| 3,877,700 | A | 4/1975 | Moe |
| 3,904,207 | A | 9/1975 | Gold |
| 3,923,305 | A | 12/1975 | Reiner et al. |
| 4,012,046 | A | 3/1977 | Liket |
| 4,129,304 | A | 12/1978 | Mager |
| 4,198,052 | A | 4/1980 | Gauselmann |
| 4,363,485 | A | 12/1982 | Edwall |
| 4,448,419 | A | 5/1984 | Telnaes |
| 4,550,916 | A | 11/1985 | Ortiz |
| 4,582,324 | A | 4/1986 | Koza et al. |
| 4,586,707 | A | 5/1986 | McNeight et al. |
| 4,593,904 | A | 6/1986 | Graves |
| 4,615,527 | A | 10/1986 | Moss |
| 4,618,150 | A | 10/1986 | Kimura |
| 4,624,459 | A | 11/1986 | Kaufman |
| 4,652,998 | A | 3/1987 | Koza et al. |
| 4,666,160 | A | 5/1987 | Hamilton |
| 4,695,053 | A | 9/1987 | Vazquez, Jr. et al. |
| 4,756,532 | A | 7/1988 | Kamille |
| 4,773,647 | A | 9/1988 | Okada et al. |
| 4,775,155 | A | 10/1988 | Lees |
| 4,781,377 | A | 11/1988 | McVean et al. |
| 4,805,907 | A | 2/1989 | Hagiwara |
| 4,826,169 | A | 5/1989 | Bessho et al. |
| 4,836,546 | A | 6/1989 | DiRe et al. |
| 4,856,787 | A | 8/1989 | Itkis |
| 4,871,171 | A | 10/1989 | Rivero |
| 4,926,327 | A | 5/1990 | Sidley |
| 4,936,588 | A | 6/1990 | Rader et al. |
| 4,948,133 | A | 8/1990 | Helm et al. |

(Continued)

FOREIGN PATENT DOCUMENTS

| | | |
|---|---|---|
| AU | 738686 | 9/1991 |
| EP | 0 449 433 | 10/1991 |

(Continued)

*Primary Examiner* — Omkar Deodhar
(74) *Attorney, Agent, or Firm* — Neal, Gerber & Eisenberg LLP

(57) ABSTRACT

A gaming system, gaming device, and method providing an obstacle board slot game. A wagering game including object starting and ending areas spaced apart in relation to one another, a plurality of obstacles and a plurality of designated target areas between the object starting area and the object ending area, and a plurality of reels including a plurality of symbols is displayed. The gaming system receives a wager, causes the reels to display a plurality of the symbols, and displays an object moving from the object starting area to one of the designated target areas and/or the object ending area along one of a plurality of object paths through the obstacles. If the object moves into one of the designated target areas, the gaming system determines whether to cause one of the reels to move and causes one of the reels to move if it so determines.

33 Claims, 13 Drawing Sheets

U.S. PATENT DOCUMENTS

| | | | |
|---|---|---|---|
| 4,964,642 | A | 10/1990 | Kamille |
| 5,001,632 | A | 3/1991 | Hall-Tipping |
| 5,016,879 | A | 5/1991 | Parker et al. |
| 5,083,271 | A | 1/1992 | Thacher et al. |
| 5,083,800 | A | 1/1992 | Lockton |
| 5,114,155 | A | 5/1992 | Tillery et al. |
| 5,116,055 | A | 5/1992 | Tracy |
| 5,120,060 | A | 6/1992 | Parker et al. |
| 5,131,655 | A | 7/1992 | Ugawa |
| 5,205,555 | A | 4/1993 | Humano |
| 5,280,909 | A | 1/1994 | Tracy |
| 5,299,810 | A | 4/1994 | Pierce et al. |
| 5,308,065 | A | 5/1994 | Bridgeman et al. |
| 5,340,317 | A | 8/1994 | Freeman |
| 5,342,047 | A | 8/1994 | Heidel et al. |
| 5,342,049 | A | 8/1994 | Wichinsky et al. |
| 5,342,058 | A | 8/1994 | Giovannetti |
| 5,344,144 | A | 9/1994 | Cannon |
| 5,393,057 | A | 2/1995 | Marnell, II |
| 5,393,061 | A | 2/1995 | Manship et al. |
| 5,397,125 | A | 3/1995 | Adams |
| 5,407,200 | A | 4/1995 | Zalabah |
| 5,409,225 | A | 4/1995 | Kelly et al. |
| 5,411,268 | A | 5/1995 | Nelson et al. |
| 5,411,271 | A | 5/1995 | Mirando |
| 5,429,361 | A | 7/1995 | Raven et al. |
| 5,449,173 | A | 9/1995 | Thomas et al. |
| 5,509,655 | A | 4/1996 | Ugawa |
| 5,524,888 | A | 6/1996 | Heidel |
| 5,531,440 | A | 7/1996 | Dabrowski et al. |
| 5,536,016 | A | 7/1996 | Thompson |
| 5,542,669 | A | 8/1996 | Charron et al. |
| 5,544,892 | A | 8/1996 | Breeding |
| 5,560,603 | A | 10/1996 | Seelig et al. |
| 5,593,349 | A | 1/1997 | Miguel et al. |
| 5,611,535 | A | 3/1997 | Tiberio |
| 5,611,730 | A | 3/1997 | Weiss |
| 5,618,045 | A | 4/1997 | Kagan et al. |
| 5,628,684 | A | 5/1997 | Bouedec |
| 5,639,089 | A | 6/1997 | Matsumoto et al. |
| 5,641,730 | A | 6/1997 | Brown |
| 5,643,088 | A | 7/1997 | Vaughn et al. |
| 5,645,281 | A | 7/1997 | Hesse et al. |
| 5,645,486 | A | 7/1997 | Nagao et al. |
| 5,647,798 | A | 7/1997 | Falciglia |
| 5,653,636 | A | 8/1997 | Takemoto et al. |
| 5,667,217 | A | 9/1997 | Kelly et al. |
| 5,676,371 | A | 10/1997 | Kelly et al. |
| 5,695,188 | A | 12/1997 | Ishibashi |
| 5,697,611 | A | 12/1997 | Kelly et al. |
| 5,700,007 | A | 12/1997 | Kelly et al. |
| 5,700,008 | A | 12/1997 | Lawlor et al. |
| 5,704,612 | A | 1/1998 | Kelly et al. |
| 5,707,285 | A | 1/1998 | Place et al. |
| 5,720,662 | A | 2/1998 | Holmes, Jr. et al. |
| 5,722,891 | A | 3/1998 | Inoue |
| 5,733,193 | A | 3/1998 | Allard et al. |
| 5,743,523 | A | 4/1998 | Kelly et al. |
| 5,743,532 | A | 4/1998 | Lafferty |
| 5,755,619 | A | 5/1998 | Matsumoto et al. |
| 5,755,621 | A | 5/1998 | Marks et al. |
| 5,766,074 | A | 6/1998 | Cannon et al. |
| 5,769,424 | A | 6/1998 | Kelly et al. |
| 5,769,716 | A | 6/1998 | Saffari et al. |
| 5,772,509 | A | 6/1998 | Weiss |
| 5,779,544 | A | 7/1998 | Seelig et al. |
| 5,779,549 | A | 7/1998 | Walker et al. |
| 5,788,230 | A | 8/1998 | Krise et al. |
| 5,788,573 | A | 8/1998 | Baerlocher et al. |
| 5,803,451 | A | 9/1998 | Kelly et al. |
| 5,803,914 | A | 9/1998 | Ryals et al. |
| 5,810,354 | A | 9/1998 | Banyai |
| 5,816,918 | A | 10/1998 | Kelly et al. |
| 5,823,873 | A | 10/1998 | Moody |
| 5,823,874 | A | 10/1998 | Adams |
| 5,833,536 | A | 11/1998 | Davids et al. |
| 5,833,537 | A | 11/1998 | Barrie |
| 5,836,586 | A | 11/1998 | Marks et al. |
| 5,836,819 | A | 11/1998 | Ugawa |
| 5,848,932 | A | 12/1998 | Adams |
| 5,851,148 | A | 12/1998 | Brune et al. |
| 5,855,514 | A | 1/1999 | Kamille |
| 5,860,648 | A | 1/1999 | Petermeier et al. |
| 5,871,398 | A | 2/1999 | Schneier et al. |
| 5,873,781 | A | 2/1999 | Keane |
| 5,882,258 | A | 3/1999 | Kelly et al. |
| 5,882,261 | A | 3/1999 | Adams |
| 5,888,115 | A | 3/1999 | Shoemaker, Jr. et al. |
| 5,890,962 | A | 4/1999 | Takemoto |
| 5,893,718 | A | 4/1999 | O'Donnell |
| 5,902,184 | A | 5/1999 | Bennett |
| 5,904,352 | A | 5/1999 | Takemoto |
| 5,910,046 | A | 6/1999 | Wada et al. |
| 5,911,418 | A | 6/1999 | Adams |
| 5,919,088 | A | 7/1999 | Weiss |
| 5,927,714 | A | 7/1999 | Kaplan |
| 5,935,002 | A | 8/1999 | Falciglia |
| 5,941,770 | A | 8/1999 | Miers et al. |
| 5,947,820 | A | 9/1999 | Morro et al. |
| 5,951,009 | A | 9/1999 | Miyamoto et al. |
| 5,951,397 | A | 9/1999 | Dickinson |
| 5,967,514 | A | 10/1999 | Kelly et al. |
| 5,976,016 | A | 11/1999 | Moody et al. |
| 5,980,384 | A | 11/1999 | Barrie |
| 5,984,782 | A | 11/1999 | Inoue |
| 5,988,643 | A | 11/1999 | Awada |
| 5,993,315 | A | 11/1999 | Strider et al. |
| 5,997,401 | A | 12/1999 | Crawford |
| 6,004,207 | A | 12/1999 | Wilson, Jr. et al. |
| 6,007,066 | A | 12/1999 | Moody |
| 6,007,426 | A | 12/1999 | Kelly et al. |
| 6,012,722 | A | 1/2000 | Petermeier et al. |
| 6,015,344 | A | 1/2000 | Kelly et al. |
| 6,015,346 | A | 1/2000 | Bennett |
| 6,019,369 | A | 2/2000 | Nakagawa et al. |
| 6,019,374 | A | 2/2000 | Breeding |
| 6,033,307 | A | 3/2000 | Vancura |
| 6,047,963 | A | 4/2000 | Pierce et al. |
| 6,048,271 | A | 4/2000 | Barcelou |
| 6,050,895 | A | 4/2000 | Luciano, Jr. et al. |
| 6,056,642 | A | 5/2000 | Bennett |
| 6,059,289 | A | 5/2000 | Vancura |
| 6,059,658 | A | 5/2000 | Mangano et al. |
| 6,062,981 | A | 5/2000 | Luciano, Jr. |
| 6,071,192 | A | 6/2000 | Weiss |
| 6,089,976 | A | 7/2000 | Schneider et al. |
| 6,089,977 | A | 7/2000 | Bennett |
| 6,089,978 | A | 7/2000 | Adams |
| 6,093,102 | A | 7/2000 | Bennett |
| 6,102,400 | A | 8/2000 | Scott et al. |
| 6,102,402 | A | 8/2000 | Scott et al. |
| 6,102,798 | A | 8/2000 | Bennett |
| 6,110,039 | A | 8/2000 | Oh |
| 6,110,041 | A | 8/2000 | Walker et al. |
| 6,110,043 | A | 8/2000 | Olsen |
| 6,117,007 | A | 9/2000 | Matsuyama et al. |
| 6,117,008 | A | 9/2000 | Machiguchi |
| 6,120,031 | A | 9/2000 | Adams |
| 6,120,377 | A | 9/2000 | McGinnis, Sr. et al. |
| 6,126,541 | A | 10/2000 | Fuchs |
| 6,126,542 | A | 10/2000 | Fier |
| 6,126,547 | A | 10/2000 | Ishimoto |
| 6,135,453 | A | 10/2000 | Srichayaporn |
| 6,135,884 | A | 10/2000 | Hedrick et al. |
| 6,135,885 | A | 10/2000 | Lermusiaux |
| 6,139,013 | A | 10/2000 | Pierce et al. |
| 6,142,873 | A | 11/2000 | Weiss et al. |
| 6,142,874 | A | 11/2000 | Kodachi et al. |
| 6,142,875 | A | 11/2000 | Kodachi et al. |
| 6,146,273 | A | 11/2000 | Olsen |
| 6,149,156 | A | 11/2000 | Feola |
| 6,159,095 | A | 12/2000 | Frohm et al. |
| 6,159,096 | A | 12/2000 | Yoseloff |
| 6,159,097 | A | 12/2000 | Gura |
| 6,159,098 | A | 12/2000 | Slomiany et al. |
| 6,165,070 | A | 12/2000 | Nolte et al. |
| 6,173,955 | B1 | 1/2001 | Perrie et al. |

6,174,235 B1 1/2001 Walker et al.
6,174,237 B1 1/2001 Stephenson
6,176,487 B1 1/2001 Eklund et al.
6,179,710 B1 1/2001 Sawyer et al.
6,186,894 B1 2/2001 Mayeroff
6,190,255 B1 2/2001 Thomas et al.
6,193,606 B1 2/2001 Walker et al.
6,203,008 B1 3/2001 Krise et al.
6,203,009 B1 3/2001 Sines et al.
6,210,279 B1 4/2001 Dickinson
6,220,593 B1 4/2001 Pierce et al.
6,220,961 B1 4/2001 Keane et al.
6,224,482 B1 5/2001 Bennett
6,224,483 B1 5/2001 Mayeroff
6,224,484 B1 5/2001 Okuda et al.
6,227,971 B1 5/2001 Weiss
6,231,442 B1 5/2001 Mayeroff
6,231,445 B1 5/2001 Acres
6,234,897 B1 5/2001 Frohm et al.
6,238,288 B1 5/2001 Walker et al.
6,251,013 B1 6/2001 Bennett
6,261,177 B1 7/2001 Bennett
6,267,669 B1 7/2001 Luciano, Jr. et al.
6,270,408 B1 8/2001 Sakamoto et al.
6,270,409 B1 8/2001 Shuster
6,270,411 B1 8/2001 Gura et al.
6,270,412 B1 8/2001 Crawford et al.
6,279,910 B1 8/2001 De Keller
6,287,194 B1 9/2001 Okada et al.
6,290,600 B1 9/2001 Glasson
6,290,603 B1 9/2001 Luciano, Jr.
6,293,866 B1 9/2001 Walker et al.
6,296,568 B1 10/2001 Tracy
6,302,790 B1 10/2001 Brossard
6,309,298 B1 10/2001 Gerou
6,309,299 B1 10/2001 Weiss
6,309,300 B1 10/2001 Glavich
6,312,334 B1 11/2001 Yoseloff
6,315,660 B1 11/2001 Demar et al.
6,315,663 B1 11/2001 Sakamoto
6,315,664 B1 11/2001 Baerlocher et al.
6,322,309 B1 11/2001 Thomas et al.
6,328,649 B1 12/2001 Randall et al.
6,340,158 B2 1/2002 Pierce et al.
6,346,043 B1 2/2002 Colin et al.
6,347,996 B1 2/2002 Gilmore et al.
6,364,765 B1 4/2002 Walker et al.
6,364,766 B1 4/2002 Anderson et al.
6,364,768 B1 4/2002 Acres et al.
6,375,187 B1 4/2002 Baerlocher
6,379,245 B2 4/2002 De Keller
6,386,974 B1 5/2002 Adams
6,390,473 B1 5/2002 Vancura et al.
6,398,219 B1 6/2002 Pierce et al.
6,398,644 B1 6/2002 Perrie et al.
6,406,369 B1 6/2002 Baerlocher et al.
6,413,160 B1 7/2002 Vancura
6,413,161 B1 7/2002 Baerlocher et al.
6,413,162 B1 7/2002 Baerlocher et al.
6,419,225 B2 7/2002 Sines et al.
6,419,226 B2 7/2002 Krise et al.
6,428,412 B1 8/2002 Anderson et al.
6,435,511 B1 8/2002 Vancura et al.
6,443,837 B1 9/2002 Jaffe et al.
6,454,651 B1 9/2002 Yoseloff
6,461,241 B1 10/2002 Webb et al.
6,464,582 B1 10/2002 Baerlocher et al.
6,467,771 B1 10/2002 deKeller
6,481,713 B2 11/2002 Perrie et al.
6,482,089 B2 11/2002 Demar et al.
6,488,580 B1 12/2002 Robb
6,506,114 B1 1/2003 Estes et al.
6,506,118 B1 1/2003 Baerlocher et al.
6,522,312 B2 2/2003 Ohshima et al.
6,533,658 B1 3/2003 Walker et al.
6,537,150 B1 3/2003 Luciano et al.
6,547,242 B1 4/2003 Sugiyama et al.
6,554,704 B2 4/2003 Nicastro et al.
6,569,015 B1 5/2003 Baerlocher et al.
6,572,473 B1 6/2003 Baerlocher
6,582,306 B1 6/2003 Kaminkow
6,599,193 B2 7/2003 Baerlocher et al.
6,602,137 B2 8/2003 Kaminkow et al.
6,605,002 B2 8/2003 Baerlocher
6,607,438 B2 8/2003 Baerlocher et al.
6,632,140 B2 10/2003 Berman et al.
6,632,141 B2 10/2003 Webb et al.
6,634,945 B2 10/2003 Glavich et al.
6,645,073 B2 11/2003 Lemay et al.
6,645,075 B1 11/2003 Gatto et al.
6,648,754 B2 11/2003 Baerlocher et al.
6,652,378 B2 11/2003 Cannon et al.
6,656,040 B1 12/2003 Brosnan et al.
6,676,512 B2 1/2004 Fong et al.
6,682,419 B2 1/2004 Webb et al.
6,682,420 B2 1/2004 Webb et al.
6,692,003 B2 2/2004 Potter et al.
6,709,332 B2 3/2004 Adams
6,722,976 B2 4/2004 Adams
6,733,386 B2 5/2004 Cuddy et al.
6,733,389 B2 5/2004 Webb et al.
6,761,632 B2 7/2004 Basenmer et al.
6,767,284 B1 7/2004 Koza
6,769,982 B1 8/2004 Brosnan
6,769,983 B2 8/2004 Slomiany
6,780,103 B2 8/2004 Bansemer et al.
6,780,111 B2 8/2004 Cannon et al.
6,786,824 B2 9/2004 Cannon
6,811,482 B2 11/2004 Letovsky
6,817,948 B2 11/2004 Pascal et al.
6,832,959 B2 12/2004 Baerlocher
6,837,793 B2 1/2005 McClintic
6,851,674 B2 2/2005 Pierce et al.
6,852,027 B2 2/2005 Kaminkow et al.
6,857,958 B2 2/2005 Osawa
6,863,606 B1 3/2005 Berg et al.
6,896,261 B2 5/2005 Pierce et al.
6,923,720 B2 8/2005 Loose
6,942,568 B2 9/2005 Baerlocher
6,960,133 B1 11/2005 Marks et al.
6,981,917 B2 1/2006 Webb et al.
7,001,274 B2 2/2006 Baerlocher et al.
7,014,560 B2 3/2006 Glavich et al.
7,052,011 B2 5/2006 Pierce et al.
7,070,502 B1 7/2006 Bussick et al.
7,156,735 B2 1/2007 Brosnan et al.
7,169,046 B2 1/2007 Webb et al.
7,192,344 B2 3/2007 Baerlocher
7,284,756 B2 10/2007 Pierce et al.
7,326,115 B2 2/2008 Baerlocher
7,357,714 B2 4/2008 Tessmer et al.
7,513,828 B2 4/2009 Nguyen et al.
7,597,618 B2 10/2009 Webb et al.
7,862,419 B2 1/2011 Baerlocher et al.
7,967,674 B2 6/2011 Baerlocher
2002/0025843 A1 2/2002 Bryant
2002/0045472 A1 4/2002 Adams
2002/0049084 A1 4/2002 Hughs-Baird et al.
2002/0059252 A1 5/2002 Yamaguchi
2002/0094855 A1 7/2002 Berman
2002/0107065 A1 8/2002 Rowe
2002/0128055 A1 9/2002 Adams
2002/0151342 A1 10/2002 Tracy et al.
2002/0160825 A1 10/2002 Nicastro et al.
2002/0198036 A1 12/2002 Baerlocher et al.
2003/0013519 A1 1/2003 Bennett
2003/0064772 A1 4/2003 Tempest et al.
2003/0064773 A1 4/2003 Baerlocher et al.
2003/0064785 A1 4/2003 Stone et al.
2003/0069064 A1 4/2003 Ainsworth
2003/0104854 A1 6/2003 Cannon
2003/0104860 A1 6/2003 Cannon et al.
2003/0114209 A1 6/2003 Ritner, Jr. et al.
2003/0114218 A1 6/2003 McClintic
2003/0114219 A1 6/2003 McClintic
2003/0114220 A1 6/2003 McClintic
2003/0119576 A1 6/2003 McClintic et al.
2003/0119581 A1 6/2003 Cannon et al.

| | | | |
|---|---|---|---|
| 2003/0125102 | A1 | 7/2003 | Cannon |
| 2003/0125107 | A1 | 7/2003 | Cannon |
| 2003/0171144 | A1 | 9/2003 | Letovsky |
| 2003/0207709 | A1 | 11/2003 | Paotrakul |
| 2003/0207710 | A1 | 11/2003 | Rodgers et al. |
| 2003/0211881 | A1 | 11/2003 | Walker et al. |
| 2004/0029631 | A1 | 2/2004 | Duhamel |
| 2004/0048650 | A1 | 3/2004 | Mierau et al. |
| 2004/0048659 | A1 | 3/2004 | Seelig et al. |
| 2004/0053673 | A1 | 3/2004 | Mishra |
| 2004/0053683 | A1 | 3/2004 | Hartl et al. |
| 2004/0072619 | A1 | 4/2004 | Brosnan et al. |
| 2004/0106446 | A1 | 6/2004 | Cannon et al. |
| 2004/0116173 | A1 | 6/2004 | Baerlocher |
| 2004/0116174 | A1 | 6/2004 | Baerlocher et al. |
| 2004/0152509 | A1 | 8/2004 | Hornik et al. |
| 2004/0198490 | A1 | 10/2004 | Bansemer et al. |
| 2004/0204226 | A1 | 10/2004 | Foster et al. |
| 2005/0014554 | A1 | 1/2005 | Walker et al. |
| 2005/0020340 | A1 | 1/2005 | Cannon |
| 2005/0026664 | A1 | 2/2005 | Bansemer et al. |
| 2005/0037838 | A1 | 2/2005 | Dunaevsky et al. |
| 2005/0181853 | A1 | 8/2005 | Baerlocher |
| 2006/0040735 | A1 | 2/2006 | Baerlocher |
| 2006/0247012 | A1 | 11/2006 | Walker et al. |
| 2007/0099688 | A1 | 5/2007 | Brosnan et al. |
| 2008/0108406 | A1 | 5/2008 | Oberberger |
| 2008/0108425 | A1 | 5/2008 | Oberberger |
| 2008/0119283 | A1 | 5/2008 | Baerlocher |
| 2009/0029758 | A1 | 1/2009 | Young |
| 2009/0061991 | A1 | 3/2009 | Popovich et al. |
| 2009/0061997 | A1 | 3/2009 | Popovich et al. |
| 2009/0061998 | A1 | 3/2009 | Popovich et al. |
| 2009/0061999 | A1 | 3/2009 | Popovich et al. |

FOREIGN PATENT DOCUMENTS

| | | | |
|---|---|---|---|
| EP | 0 874 337 | | 10/1998 |
| EP | 0 945 837 | | 9/1999 |
| EP | 0 984 408 | | 3/2000 |
| EP | 0 984 409 | | 3/2000 |
| EP | 1 184 822 | A2 | 3/2002 |
| GB | 1 292 712 | | 10/1972 |
| GB | 2 033 638 | | 5/1980 |
| GB | 2 090 690 | A | 7/1982 |
| GB | 2 096 376 | A | 10/1982 |
| GB | 2 097 160 | A | 10/1982 |
| GB | 2 098 781 | | 11/1982 |
| GB | 2 100 905 | A | 1/1983 |
| GB | 2 105 891 | A | 3/1983 |
| GB | 2 106 295 | | 4/1983 |
| GB | 2 117 155 | A | 10/1983 |
| GB | 2 117 952 | | 10/1983 |
| GB | 2 137 392 | A | 10/1984 |
| GB | 2 161 008 | A | 1/1986 |
| GB | 2 170 636 | A | 8/1986 |
| GB | 2 181 589 | A | 4/1987 |
| GB | 2 183 882 | A | 6/1987 |
| GB | 2 191 030 | A | 12/1987 |
| GB | 2 222 712 | A | 3/1990 |
| GB | 2 225 889 | A | 6/1990 |
| GB | 2 226 436 | A | 6/1990 |
| GB | 2 242 300 | A | 9/1991 |
| GB | 2 262 642 | A | 6/1993 |
| GB | 2 341 262 | | 3/2000 |
| WO | WO 00/12186 | | 3/2000 |
| WO | WO 2004/078297 | | 9/2004 |
| WO | WO 2005/094954 | | 10/2005 |

GAMING SYSTEM, GAMING DEVICE, AND METHOD PROVIDING AN OBSTACLE BOARD SLOT GAME

CROSS REFERENCE TO RELATED APPLICATIONS

This application relates to the following co-pending commonly owned patent application: "GAMING SYSTEM, GAMING DEVICE, AND METHOD PROVIDING AN OBSTACLE BOARD SLOT GAME," U.S. patent application Ser. No. 13/238,806.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Many gaming devices generate and display symbols in response to a wager by a player. For example, certain gaming devices employ a plurality of reels that each include a plurality of symbols. These gaming devices enable a player to place a wager on one or more paylines associated with symbol positions. For each of the reels, certain of the symbols on that reel are generated independently from the symbols on each of the other reels to provide a combination of symbols. A single activation of the set of reels typically leads to a single display of symbols arranged along the paylines to be evaluated for any awards. If a winning symbol or winning combination of symbols is generated and displayed along a wagered-on payline, an award is provided for that payline. If a winning symbol or combination of symbols is not generated and displayed along a wagered-on payline, no award is provided for that payline.

There are a variety of games to play in casinos and other gaming environments, such as online gaming environments, that involve the use of an obstacle board such as a peg board. One such known game utilizes a quincunx board, also known as a Plinko or Galton board. One mechanical quincunx board is a vertical board including a plurality interleaved rows of pins, pegs, or nails. The pins, pegs, or nails are arranged in a geometric pattern known as a quincunx. The quincunx includes five coplanar pins, pegs, or nails, four of them forming a square or rectangle and a fifth at the square or rectangle's center. Each pin, peg, or nail is typically equidistant from each of the pins, pegs, or nails diagonally adjacent to it. Each pin, peg, or nail is typically equidistant from each of the pins, pegs, or nails horizontally adjacent to it. Each pin, peg, or nail is typically equidistant from each of the pins, pegs, or nails vertically adjacent to it. The distance between diagonally adjacent pins, pegs, or nails is not necessarily equal to the distance between horizontally adjacent pins, pegs, or nails, which in turn is not necessarily equal to the distance between vertically adjacent pins, pegs, or nails. During play of the game, balls or discs are dropped from the top of the quincunx board. As gravity pulls the balls or discs through the array of pins, pegs, or nails, the balls or discs collide with the pins, pegs, or nails and change direction, speed, and/or rotation as a result. Eventually, the balls or discs reach the bottom of the quincunx board and are collected into bins. Computerized or video games that mimic a mechanical quincunx board have also been implemented.

Pachinko is another such known game. A mechanical pachinko device includes of a network of mechanical pins, pegs, or nails spaced apart in a predefined, sometimes irregular manner extending from a board or background. The pachinko device utilizes small steel balls. A player places a wager on the pachinko game and receives a number of the balls in a loading area. In one known system, the player pulls a spring-loaded pinball-like handle or knob and shoots a single ball into an upright or angled play area where the ball bounces from one pin, peg, or nail to another, through the network of pegs or nails. In another known system, the player sets a motor speed so that the ball speed falls somewhere between barely entering the play area to entering the play area at a high rate of speed. In either system, the ball falls through the network of pins, pegs, or nails either unsuccessfully to the bottom of the play area or successfully into a winning pocket, whereby the player wins a prize and/or a special mode of operation is activated. Computerized or video pachinko games that mimic a mechanical pachinko game have also been implemented. Games involving a quincunx board and pachinko games are simple, interactive, and considered by many to be fun and exciting to watch or play.

Gaming device manufacturers strive to make gaming devices that provide as much enjoyment and excitement as possible. Players are also attracted to gaming devices that provide new game schemes and interactive features. Therefore, to increase player enjoyment and excitement, it is desirable to provide players with new types of games, game schemes, and features for gaming devices. A continuing need thus exists to provide new and exciting gaming systems, gaming devices, and methods of operating these new and exciting gaming systems and gaming devices.

SUMMARY

Various embodiments of the present disclosure provide gaming systems, gaming devices, and methods of operating the gaming systems and gaming devices providing an obstacle board slot game. Generally, the gaming systems and gaming devices of the present disclosure provide a play of a primary game, determine a primary game outcome for the play of the primary game, and determine whether to modify the primary game outcome based on the outcomes of one or more random events determined independently of the primary game outcome. More specifically, in various embodiments the gaming systems and devices of the present disclosure display a play of a primary game and determine an outcome of that play of the primary game. Before, during, or after displaying that play of the primary game, in these embodiments the gaming systems and devices display a plurality of random events and determine a random event outcome for each of those random events. Each random event outcome is determined separately, distinctly, and independently from the outcome of that play of the primary game. For each of the random events, if the random event outcome of that random event is a designated random event outcome, in these embodiments the gaming systems and devices determine whether to modify the outcome of said play of the primary game and, if the gaming systems and devices determine to modify the outcome of said play of the primary game, the gaming systems and devices modify the outcome of said play of the primary game.

In one embodiment, the gaming system displays a wagering game including an object starting area, an object ending area spaced apart in relation to the object starting area, a plurality of obstacles between the object starting area and the object ending area, one or more designated target areas between the object starting area and the object ending area, and a plurality of reels. The object ending area is configured to receive one or more objects. Each of the reels includes a plurality of different symbols. The gaming system receives a wager from a player, causes the reels to display a plurality of the symbols, and displays at least one object moving from the object starting area to one of the designated target areas and/or the object ending area along one of a plurality of different object paths through the obstacles. If one of the objects moves into one of the designated target areas, the gaming system determines whether to cause at least one of the reels to move. If the gaming system determines to cause at least one of the reels to move, the gaming system causes said reel to move. The gaming system determines whether the reels display at least one of a plurality of different predetermined winning combinations of the symbols, and provides the player an award for any winning combinations of the symbols displayed on the reels.

In another embodiment, each of the designated target areas includes a designated object landing configured to receive an object. In this embodiment, the gaming system receives a wager from a player, causes the reels to display a plurality of the symbols, and displays at least one object moving from the object starting area to one of the designated object landings or the object ending area along one of the different object paths through the obstacles. In this embodiment, the gaming system determines whether to cause at least one of the reels to move when one of the designated object landings receives an object.

Additional features and advantages are described herein, and will be apparent from, the following Detailed Description and the Figures.

DETAILED DESCRIPTION

Gaming Device and Electronics

The present disclosure may be implemented, in various configurations for gaming machines, gaming devices, or gaming systems, including but not limited to: (1) a dedicated gaming machine, gaming device, or gaming system wherein the computerized instructions for controlling any games (that are provided by the gaming machine or gaming device) are provided with the gaming machine or gaming device prior to delivery to a gaming establishment; and (2) a changeable gaming machine, gaming device, or gaming system wherein the computerized instructions for controlling any games (that are provided by the gaming machine or gaming device) are downloadable to the gaming machine or gaming device through a data network (such as the Internet) after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces), and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
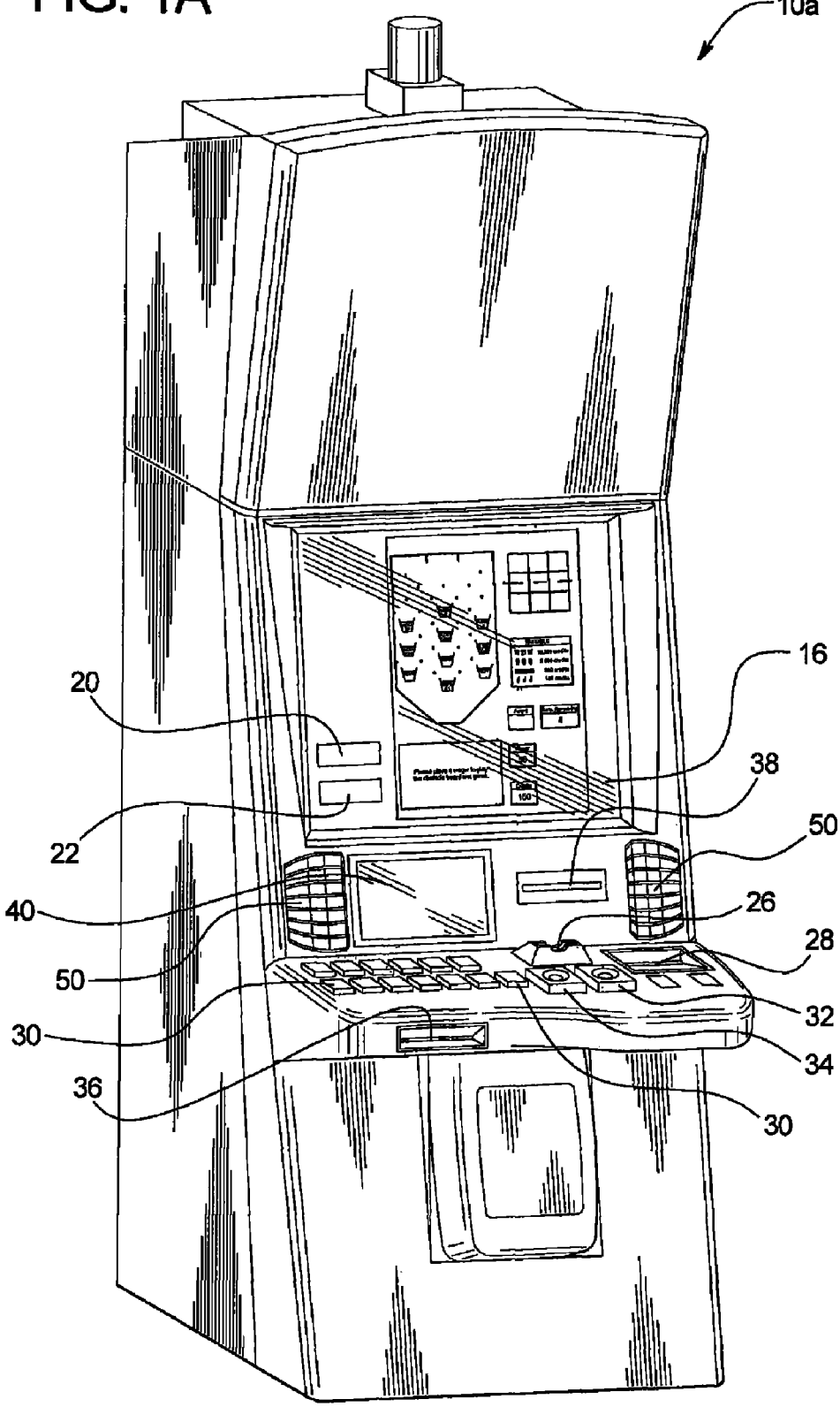
FIGS. 1A and 1B are front perspective views of alternative embodiments of gaming devices disclosed herein.
Figure 1B:
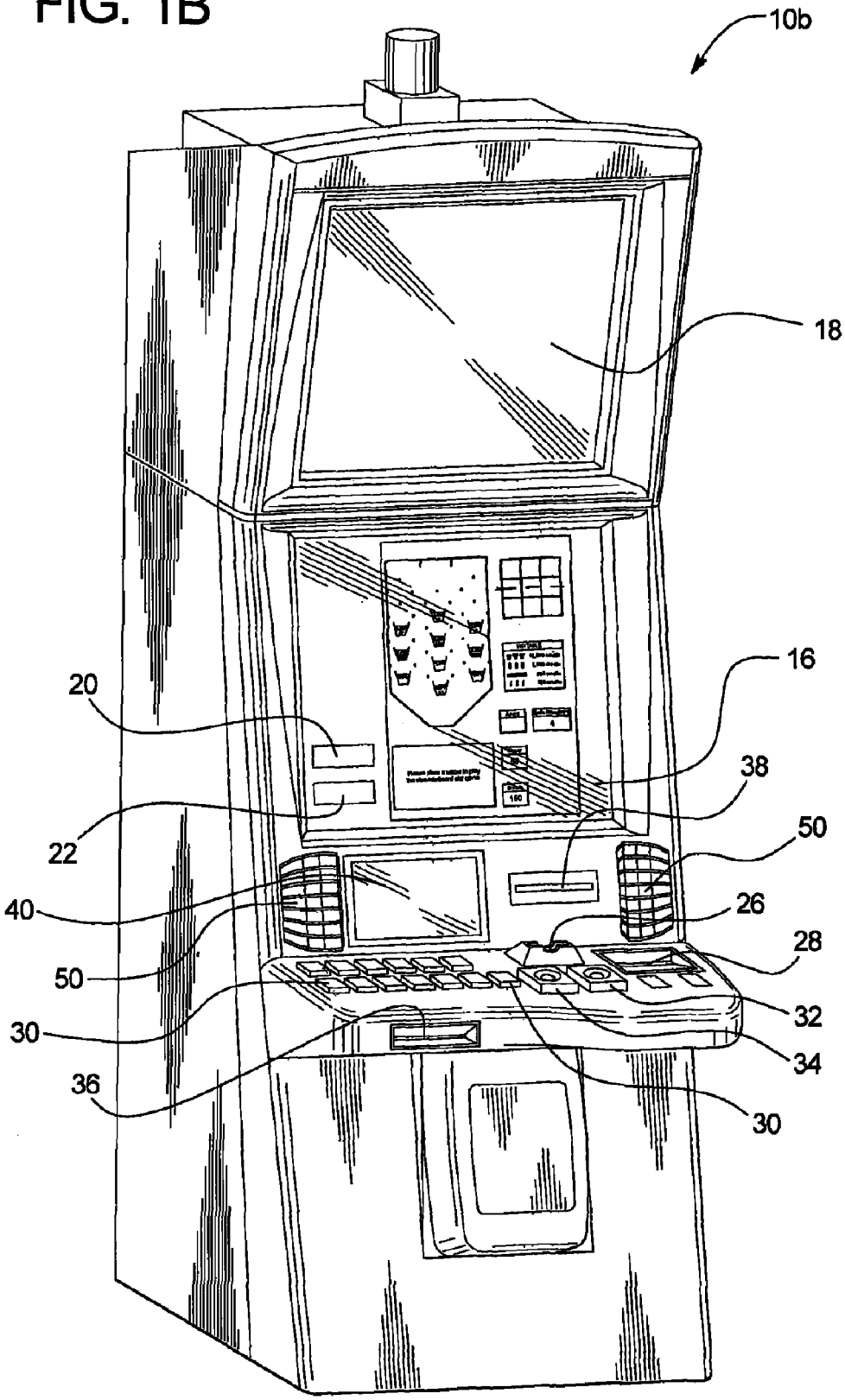

Referring now to the drawings, two example alternative embodiments of a gaming device that implements the obstacle board slot game disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet that provides support for a plurality of displays, inputs, controls, and other features of a conventional gaming machine. It is configured so that a player may operate it while standing or sitting. The gaming device may be positioned on a base or stand or may be configured as a pub-style table-top game (not shown) that a player may operate preferably while sitting. As illustrated by the different configurations shown in FIGS. 1A and 1B, the gaming device may have varying cabinet and display configurations.

Figure 2A:
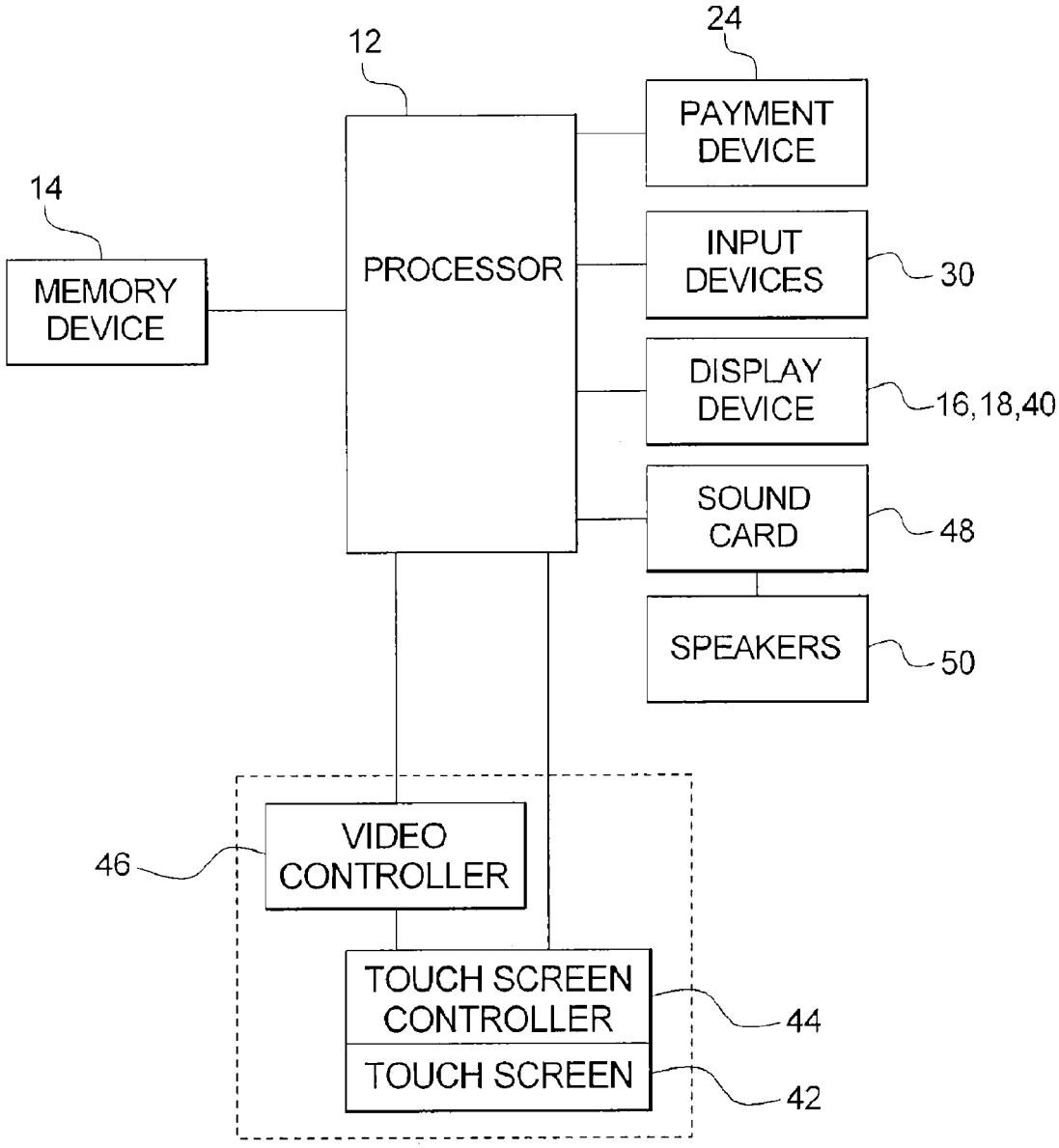
FIG. 2A is a schematic block diagram of an electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit, or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which may include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above may be stored in a detachable or removable memory device, such as, but not limited to, a suitable cartridge, disk, CD ROM, DVD, or USB memory device. In other embodiments, part or all of the program code and/or operating data described above may be downloaded to the memory device through a suitable network.

In one embodiment, an operator or a player may use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, such as part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 that displays a primary game. In one embodiment, the primary game is the obstacle board slot game. This display device may also display any suitable secondary game associated with the primary game as well as information relating to the primary or secondary game. In another embodiment, the secondary game is the obstacle board slot game. The alternative embodiment shown in FIG. 1B includes a central display device 16 and an upper display device 18. The upper display device may display the primary game, any suitable secondary game associated or not associated with the primary game, and/or information relating to the primary or secondary game. These display devices may also serve as digital glass operable to advertise games or other aspects of the gaming establishment. As shown in FIGS. 1A and 1B, in one embodiment, the gaming device includes a credit display 20 that displays a player's current number of credits, cash, account balance, or the equivalent. In one embodiment, the gaming device includes a bet display 22 that displays a player's amount wagered. In one embodiment, as discussed in more detail below, the gaming device includes a player tracking display 40 that displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as discussed in more detail below, the display device includes a touch-screen with an associated touch-screen controller. The display devices may be of any suitable size and configuration, such as a square, a rectangle, or an elongated rectangle.

The display devices of the gaming device are configured to display at least one and preferably a plurality of game or other suitable images, symbols, and indicia such as any visual representation or exhibition of the movement of objects such as mechanical, virtual, or video reels and wheels; dynamic lighting; video images; images of people, characters, places, things, or faces of cards; and the like.

In one alternative embodiment, the symbols, images, and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As shown in FIGS. 1A and 1B, a payment device such as a payment acceptor includes a note, ticket, or bill acceptor 28 into which the player inserts paper money, a ticket, or a voucher and a coin slot 26 into which the player inserts money, coins, or tokens. In other embodiments, payment devices such as readers or validators for credit cards, debit cards, or credit slips may accept payment. In one embodiment, a player may insert an identification card into a card reader of the gaming device. In one embodiment, the identification card is a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, that communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as discussed above.

As shown in FIGS. 1A, 1B, and 2A, in one embodiment the gaming device includes at least one and preferably a plurality of input devices 30 in communication with the processor. The input devices may include any suitable device that enables the player to produce an input signal that is received by the processor. In one embodiment, after appropriate funding of the gaming device, the input device is a game activation device, such as a play button 32 or a pull arm (not shown) that is used by the player to start any primary game or sequence of events in the gaming device. The play button may be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player may increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) that enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as shown in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player may make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as shown in FIG. 2A, the gaming device includes a sound generating device controlled by one or more sound cards 48 that function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera and to display the visible manifestation of the game in split screen or picture-in-picture fashion. For example, the camera may acquire an image of the player and the processor may incorporate that image into the primary and/or secondary game as a game image, symbol, or indicia.

In addition to incorporating the primary game elements of the present disclosure, gaming device 10 may incorporate any suitable secondary wagering game. The secondary wagering game may be incorporated into the primary game or playable independent of the primary game. The gaming machine or device may include some or all of the features of conventional gaming machines or devices. The secondary wagering game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different wagering games, such as video poker games, video blackjack games, video keno games, video bingo games, or any other suitable game or games may be implemented.

In one embodiment, the obstacle board slot game and/or the secondary wagering game may include a slot game with one or more paylines. The paylines may be horizontal, vertical, circular, diagonal, angled, or any combination thereof. In this embodiment, the gaming device includes at least one and preferably a plurality of reels, such as three to five reels, in either electromechanical form with mechanical rotating reels or video form with simulated reels and movement thereof. In one embodiment, an electromechanical slot machine includes a plurality of adjacent, rotatable reels that may be combined and operably coupled with an electronic display of any suitable type. In another embodiment, if the reels are in video form, one or more of the display devices, as discussed above, displays the plurality of simulated video reels. Each reel displays a plurality of indicia or symbols, such as bells, hearts, fruits, numbers, letters, bars, or other images that preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the secondary wagering game stop spinning if specified types and/or configurations of indicia or symbols occur on an active payline or otherwise occur in a winning pattern, occur on the requisite number of adjacent reels, and/or occur in a scatter pay arrangement.

In an alternative embodiment, rather than determining any outcome to provide to the player by analyzing the symbols generated on any wagered upon paylines as discussed above, the gaming device determines any outcome to provide to the player based on the number of associated symbols that are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if a reel is activated based on the player's wager, then each of the symbol positions of that reel will be activated and each of the active symbol positions will be part of one or more of the ways to win. In one embodiment, if a reel is not activated based on the player's wager, then a designated number of default symbol positions, such as a single symbol position of the middle row of the reel, will be activated and the default symbol position(s) will be part of one or more of the ways to win. This type of gaming machine enables a player to wager on one, more than one, or all of the reels, and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as discussed above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as discussed above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols that form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as discussed above for each of the remaining classified strings of related symbols that were previously classified or formed from related symbols on the first and second reels.

After analyzing each of the remaining strings of related symbols, the gaming device determines, for each remaining pending or incomplete string of related symbols, if any of the symbols from the next adjacent reel should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, the secondary wagering game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table that utilizes conventional poker hand rankings to determine the winning hands. The gaming device provides the player with an award based on a winning hand and the number of credits the player wagered.

In another embodiment, the secondary wagering game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, the secondary wagering game may be a keno game wherein the gaming device displays a plurality of selectable indicia or numbers on at least one of the display devices. In this embodiment, the player selects at least one of a plurality of the selectable indicia or numbers via an input device such as a touch screen. The gaming device then displays a series of drawn numbers and determines an amount of matches, if any, between the player's selected numbers and the gaming device's drawn numbers. The player is provided an award based on the amount of matches, if any, based on the amount of determined matches and the number of numbers drawn.

In one embodiment, the primary game may include a triggering event or qualifying condition that gives players the opportunity to win credits in a secondary or bonus game or in a secondary or bonus round. The bonus or secondary game enables the player to obtain a prize or payout in addition to the prize or payout, if any, obtained from the base or primary game. In general, a secondary or bonus game (referred to interchangeably herein) produces a significantly higher level of player excitement than the primary game because it provides a greater expectation of winning than the base or primary game, and is accompanied with more attractive or unusual features than the primary game. In one embodiment, the secondary game may be any type of suitable game, either similar to or completely different from the primary game.

In one embodiment, the triggering event or qualifying condition may be a selected outcome in the primary game or a particular arrangement of one or more indicia on a display device in the primary game. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a bonus or secondary game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program that will automatically begin a bonus round after the player has achieved a triggering event or qualifying condition in the base or primary game. In another embodiment, after a player has qualified for a bonus game, the player may subsequently enhance his/her bonus game participation through continued play on the primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather, the player must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
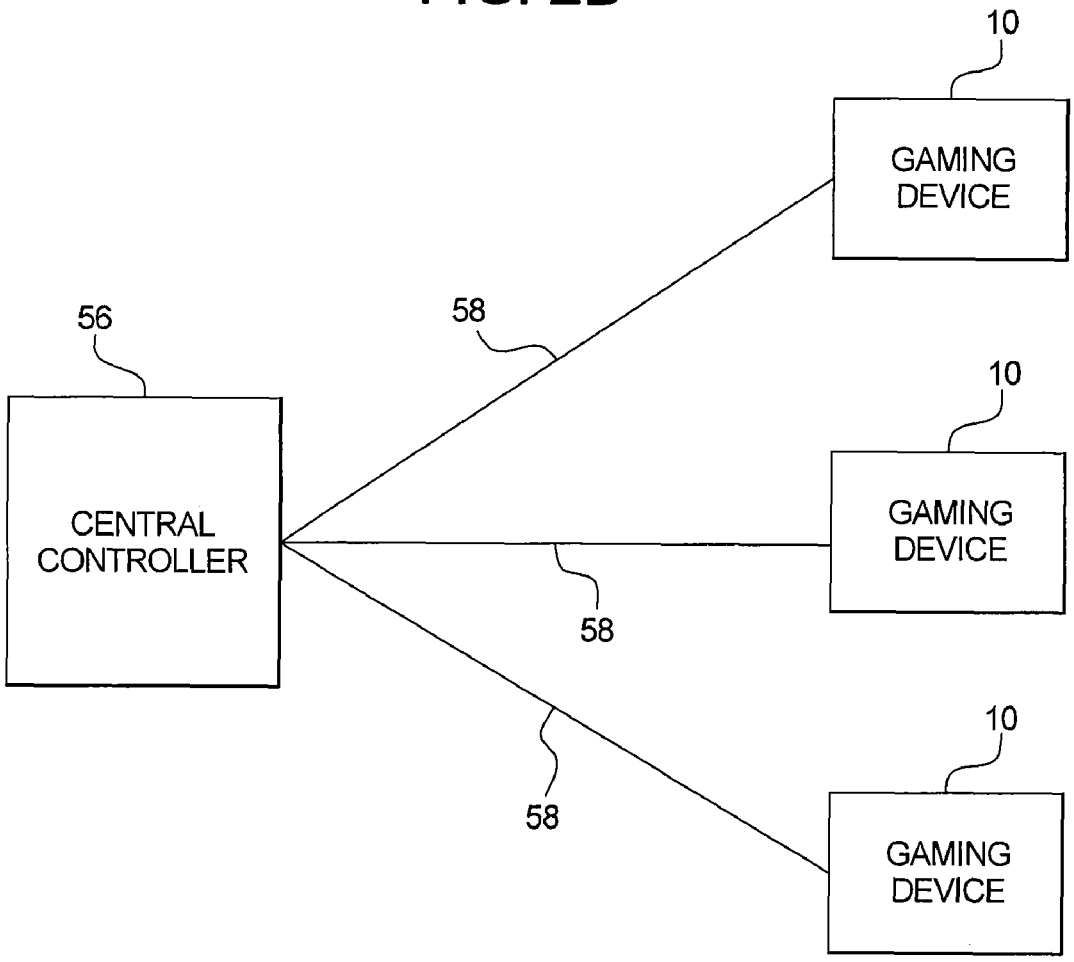
FIG. 2B is a schematic diagram of the central server in communication with a plurality of gaming devices in accordance with one embodiment of the gaming system disclosed herein.

In one embodiment, as illustrated in FIG. 2B, one or more of the gaming devices 10 are in communication with each other and/or at least one central controller 56 through a data network or remote communication link 58. In this embodiment, the central server, central controller, or remote host is any suitable server or computing device that includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more, or each of the functions of the central controller, central server, or remote host as disclosed herein may be performed by one or more gaming device processors. It should be further appreciated that one, more, or each of the functions of one or more gaming device processors as disclosed herein may be performed by the central controller, central server, or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome may include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a designated object landing on a designated space in a wheel, is also determined by the central server or controller and communicated to the initiated gaming device to be presented or displayed to the player. Central production or control may assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno, or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination may be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As discussed above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10, which will be provided to a first player regardless of how the first player plays in a first game, and a second gaming device to have selected elements marked in a different predetermined pattern is provided a second outcome of win $2, which will be provided to a second player regardless of how the second player plays a second game. It should be appreciated that as the process of marking selected elements continues until one or more predetermined patterns are marked, this embodiment ensures that at least one bingo card will win the bingo game, and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as discussed above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as discussed above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card that has an encoded player identification number that uniquely identifies the player. When a player inserts the player's playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes the player's player tracking card when concluding play for that gaming session. In another embodiment, rather than requiring a player to insert a player tracking card, the gaming device utilizes one or more portable devices carried by a player, such as a cell phone, a radio frequency identification tag, or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) that are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device may be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as discussed above, one or more gaming devices are in communication with a central server or controller. The central server or controller may be any suitable server or computing device that includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game that may be played on one or more of the gaming devices in the gaming system. Such different games may include the same or substantially the same game play with different pay tables. In different embodiments, the executable game program is for a primary game, a secondary game, or both. In another embodiment, the game program may be executable as a secondary game to be played simultaneous with the play of a primary game (that may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or, alternatively, with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager that the player may make (and that may be tracked via a side-bet meter). In one embodiment, one or more of the progressive awards are funded with only side-bets or side-wagers placed. In another embodiment, one or more of the progressive awards are funded based on players' wagers as discussed above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, among the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Obstacle Board Slot Game

Figure 3:
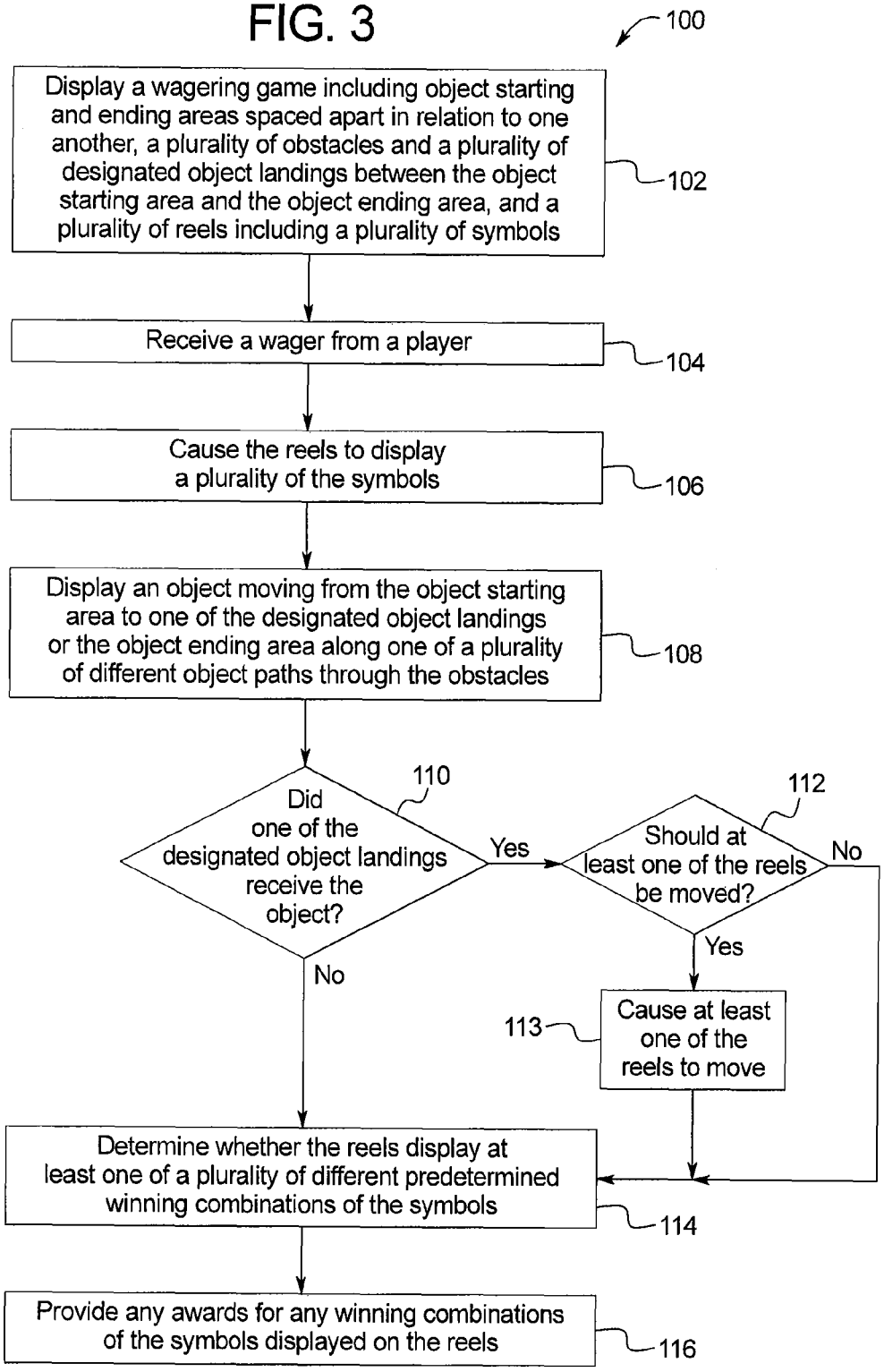
FIG. 3 is a flowchart illustrating one embodiment of a method of operating the gaming system disclosed herein.

FIG. 3 illustrates a flowchart of one example embodiment of a process or method 100 for operating a gaming system or a gaming device configured to operate the obstacle board slot game of the present disclosure. In one embodiment, this process 100 is embodied in one or more software programs stored in one or more memories and executed by one or more processors or controllers. Although this process 100 is described with reference to the flowchart shown in FIG. 3, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In operation of one embodiment, the gaming system displays a wagering game including object starting and ending areas spaced apart in relation to one another; a plurality of obstacles between the object starting area and the object ending area; a plurality of designated target areas that, in this embodiment, are designated object landings, between the object starting area and the object ending area; and a plurality of reels including a plurality of symbols, as indicated by block 102. The gaming system receives a wager from a player, as indicated by block 104. The gaming system causes the reels to display a plurality of the symbols, as indicated by block 106. The gaming system displays an object moving from the object starting area to one of the designated object landings or the object ending area along one of a plurality of different object paths through the obstacles, as indicated by block 108. The gaming system determines whether one of the designated object landings received the object, as indicated by diamond 110. If one of the designated object landings received the object, the gaming system determines whether to cause at least one of the reels to move, as indicated by diamond 112. If the gaming system determines to cause at least one of the reels to move, the gaming system causes at least one of the reels to move, as indicated by block 113. The gaming system determines whether the reels display at least one of a plurality of different predetermined winning combinations of the symbols, as indicated by block 114. The gaming system provides any awards for any displayed winning combinations of the symbols, as indicated by block 116.

If one of the designated object landings received the object, and if the gaming system determines not to cause at least one of the reels to move, the gaming system determines whether the reels display at least one of the winning combinations of the symbols, as indicated by block 114, and provides any awards for any displayed winning combinations of the symbols, as indicated by block 116.

If one of the designated object landings does not receive the object, the gaming system determines whether the reels display at least one of the winning combinations of the symbols, as indicated by block 114, and provides any awards for any displayed winning combinations of the symbols, as indicated by block 116.

It should be appreciated that the gaming system may repeat block 108 to block 113 until a termination condition occurs. In certain embodiments, the termination condition occurs when a winning symbol combination or a designated winning symbol combination is displayed. In other embodiments, the termination condition occurs when a designated quantity of objects has fallen into the obstacle area. In various embodiments, the termination condition occurs when a designated period of time has elapsed. It should be appreciated that any suitable termination condition may be employed.

FIGS. 4A, 4B, 4C, 4D, 4E, 4F, 4G, and 4H illustrate screen shots of a display device of one example embodiment of a gaming system, gaming device, and method of operating the gaming system and gaming device configured to operate the obstacle board slot game of the present disclosure (sometimes referred to herein as "game" or "wagering game"). The wagering game includes a primary game and an obstacle board game. In general, an outcome of the primary game is determined, and that outcome may be modified by the outcomes of one or more random events associated with the obstacle board game. In this embodiment, the primary game is a spinning-reel type slot game, though it should be appreciated that the primary game may be any suitable game such as, but not limited to, another spinning reel-type game, a card game such as blackjack or poker, a roulette game, a keno game, or a bingo game.

The gaming system includes a display device 119 that displays the primary spinning reel-type slot game including a plurality of reels 160*a*, 160*b*, and 160*c*, each of which includes a plurality of symbols, and a plurality of symbol display areas 161*a*, 161*b*, 161*c*, 161*d*, 161*e*, 161*f*, 161*g*, 161*h*, and 161*i*. Reel 160*a* displays symbols at symbol display areas 161*a*, 161*d*, and 161*g*; reel 160*b* displays symbols at symbol display areas 161*b*, 161*e*, and 161*h*; and reel 160*c* displays symbols at symbol display areas 161*c*, 161*f*, and 161*i*.

Display device 119 displays a payline that is associated with a plurality of the symbol display areas. Specifically, payline A 162*a* is associated with symbol display areas 161*d*, 161*e*, and 161*f*. For clarity and brevity, payline A 162*a* is sometimes referred to herein as payline A. Display device 119 displays a paytable 122 for the wagering game that includes a plurality of winning symbol combinations. Paytable 122 indicates the credit payout associated with each respective winning symbol combination. In this illustrated embodiment, paytable 122 indicates the credit payout associated with each respective winning symbol combination when the maximum wager, which is 50 credits in this embodiment (but could be any suitable amount), is placed by a player for a play of the wagering game. More specifically, winning symbol combination SEVEN-SEVEN-SEVEN is associated with an award of 10,000 credits; winning symbol combination DOLLAR SIGN-DOLLAR SIGN-DOLLAR SIGN is associated with an award of 5,000 credits; winning symbol combination BAR-BAR-BAR is associated with an award of 500 credits; and winning symbol combination CHERRY-CHERRY-CHERRY is associated with an award of 100 credits.

It should be appreciated that the display device may display any suitable quantity of reels including any suitable quantity of corresponding symbol display areas in any suitable configuration or arrangement. It should also be appreciated that the display device may display any suitable quantity of paylines for the wagering game. It should further be appreciated that each of the displayed paylines may be associated with any suitable quantity of the symbol display areas and any suitable combination of the symbol display areas. It should be appreciated that any other suitable award determination other than a payline evaluation may be used, such as a ways to win and/or a scatter pay award determination (described in detail above). It should be appreciated that the paytable may be modified to reflect lower credit payouts when a wager that is less than the maximum wager is placed by the player for the wagering game. It should also be appreciated that any suitable paytable including any suitable quantity of winning symbol combinations may be employed, that any suitable combination of the symbols may be used as a winning symbol combination, and that the winning symbol combinations may be associated with any suitable credit payouts. It should also be appreciated that any suitable quantity of paytables may be utilized. It should further be appreciated that any suitable symbols may be employed. The symbols may include, for example, any suitable markings or indicia such as letters, numbers, or illustrations or pictures of objects.

Display device 119 displays the obstacle board game, which includes an obstacle board game area 120. Obstacle board game area 120 includes an object starting area 130, an obstacle area 140 positioned beneath object starting area 130, and an object ending area 150 positioned beneath obstacle area 140. Object starting area 130 includes object starting positions 130*a*, 130*b*, and 130*c*. Obstacle area 140 includes obstacles 140*a*, 140*b*, 140*c*, 140*d*, 140*e*, 140*f*, 140*g*, 140*h*, 140*i*, 140*j*, 140*k*, 1401, 140*m*, 140*n*, 140*o*, 140*p*, 140*q*, 140*r*, 140*s*, 140*t*, 140*u*, 140*v*, 140*w*, 140*x*, 140*y*, 140*z*, 140*aa*, 140*bb*, and 140*cc*. Object ending area 150 includes object ending position 150*a*. In this embodiment, obstacles 140*a* to 140*cc* are pegs. Accordingly, in this example embodiment, obstacles 140*a* to 140*cc* are referred to herein as pegs 140*a* to 140*cc* and obstacle area 140 is referred to herein as peg area 140.

Peg area 140 also includes designated target areas. In this embodiment, the designated target areas are designated object landings 142*a*, 142*b*, 142*c*, 142*d*, 142*e*, 142*f*, 142*g*, 142*h*, 142*i*, and 142*j*, each of which is configured to receive an object. In this example, the object is a ball, though it should be appreciated that any suitable object may be employed. Each of the designated object landings (i.e., each of the designated target areas in this embodiment) is associated with a modification of one or more of reels 160*a*, 160*b*, and 160*c* such that, when one of the designated object landings receives an object (explained in detail below), the gaming system determines whether to modify one or more of the reels and, if the gaming system determines to modify one or more of the reels, effectuates the modification associated with that designated object landing. In this embodiment, the modifications occur after the reels have spun, though it should be appreciated that, in certain embodiments, the modifications may occur before or during the spinning of the reels. It should be appreciated that the designated target areas may be associated with any suitable portion of the peg area. For example, in certain embodiments, the designated target areas are not designated object landings configured to receive an object. Rather, in these embodiments the designated target areas are designated areas or portions of the obstacle area that may, in some embodiments, be identified to the player. In one example embodiment, the gaming system determines whether to modify one or more of the reels when an object passes through the designated target area portion of the obstacle area on its way through the obstacle area. It should be appreciated that in certain of these embodiments, the object may pass through more than one designated target area on its way through the obstacle area. In another embodiment in which the obstacle board slot game includes a plurality of object ending areas, one or more of the object ending areas are designated target areas. It should be appreciated that any suitable designated target area or areas may be employed.

In this embodiment, each of the modifications is a specific movement of one or more of the reels. Specifically, when designated object landing 142*a* receives an object and the gaming system determines to modify one or more of the reels, reel 160*b* is nudged (i.e., moved or rotated) upward such that: (a) the symbol displayed in symbol display area 161*b* is removed from symbol display area 161*b*, (b) the symbol displayed in symbol display area 161*e* moves to symbol display area 161*b*, (c) the symbol displayed in symbol display area 161*h* moves to symbol display area 161*e*, and (d) a new symbol is displayed in symbol display area 161*h*. When designated object landing 142*b* receives an object and the gaming system determines to modify one or more of the reels, reel 160*a* is nudged upward such that: (a) the symbol displayed in symbol display area 161*a* is removed from symbol display area 161*a*, (b) the symbol displayed in symbol display area 161*d* moves to symbol display area 161*a*, (c) the symbol displayed in symbol display area 161*g* moves to symbol display area 161*d*, and (d) a new symbol is displayed in symbol display area 161*g*. When designated object landing 142*c* receives an object and the gaming system determines to modify one or more of the reels, reel 160*c* is nudged upward such that: (a) the symbol displayed in symbol display area 161*c* is removed from symbol display area 161*c*, (b) the symbol displayed in symbol display area 161*f* moves to symbol display area 161*c*, (c) the symbol displayed in symbol display area 161*i* moves to symbol display area 161*f*, and (d) a new symbol is displayed in symbol display area 161*i*. When designated object landing 142*d* receives an object and the gaming system determines to modify one or more of the reels, reel 160*b* is nudged downward such that: (a) the symbol displayed in symbol display area 161*h* is removed from symbol display area 161*h*, (b) the symbol displayed in symbol display area 161*e* moves to symbol display area 161*h*, (c) the symbol displayed in symbol display area 161*b* moves to symbol display area 161*e*, and (d) a new symbol is displayed in symbol display area 161*b*. When designated object landing 142*e* receives an object and the gaming system determines to modify one or more of the reels, reel 160*a* is nudged downward such that: (a) the symbol displayed in symbol display area 161*g* is removed from symbol display area 161*g*, (b) the symbol displayed in symbol display area 161*d* moves to symbol display area 161*g*, (c) the symbol displayed in symbol display area 161*a* moves to symbol display area 161*d*, and (d) a new symbol is displayed in symbol display area 161*a*. When designated object landing 142*f* receives an object and the gaming system determines to modify one or more of the reels, reel 160*c* is nudged downward such that: (a) the symbol displayed in symbol display area 161*i* is removed from symbol display area 161*i*, (b) the symbol displayed in symbol display area 161*f* moves to symbol display area 161*i*, (c) the symbol displayed in symbol display area 161*c* moves to symbol display area 161*f*, and (d) a new symbol is displayed in symbol display area 161*c*. When designated object landing 142*g* receives an object and the gaming system determines to modify one or more of the reels, reel 160*b* is respun. When designated object landing 142*h* receives an object and the gaming system determines to modify one or more of the reels, reel 160*a* is respun. When designated object landing 142*i* receives an object and the gaming system determines to modify one or more of the reels, reel 160*c* is respun. When designated object landing 142*j* receives an object and the gaming system determines to modify one or more of the reels, all of reels 160*a*, 160*b*, and 160*c* are respun.

Thus, it should be appreciated that each designated object landing is associated with one or more of the reels and a modification. When an object lands in one of the designated object landings and the gaming system determines to modify one or more of the reels, the gaming system effectuates the modification associated with that designated object landing on the reel or reels associated with that designated object landing. It should be appreciated that the reels associated with the designated object landings may be determined in any suitable manner. In one embodiment, the gaming system randomly associates one or more reels with each of the designated object landings. In another embodiment, the reels that are associated with the designated object landings are predetermined. In another embodiment, the play may determine one or more reels to associated with one or more designated object landings. In some embodiments, the location of the designated object landing within the obstacle area determines with which reel (or reels, in some embodiments) the designated object landing is associated with. For example, in certain embodiments in which the primary game is a three reel slot game, designated object landings on the left side of the obstacle area are associated with the leftmost reel, designated object landings in the middle of the obstacle area are associated with the center reel, and designated object landings on the right side of the obstacle area are associated with the rightmost reel. It should be appreciated that the designated object landings may be labeled with the type of modification they provide and/or the reels that they modify.

It should be appreciated that any suitable modification may be associated with one or more of the designated object landings. For example, in various embodiments, when an object lands in a designated object landing, if the gaming system determines to do so the gaming system causes at least one of: (a) a respin of a plurality of the reels, (b) a replacement of one or more of the symbols on one or more of the reels, (c) certain of the reels to lock (i.e., preventing them from being respun), (d) a modification of one or more of the reels for a subsequent play or plays of a game, (e) the gaming system to enable a player to select which reel(s) to respin, (f) a nudge of the reels in a player-selected manner, (g) a nudge of the reels a plurality of times, (h) a nudge of a plurality of the reels in the same or different directions, (i) an addition of one or more different winning symbol combinations to the paytable, (j) an addition of at least one WILD symbol to one or more of the reels, (k) an addition to or subtraction from the designated quantity of objects, (l) an addition to or subtraction from the displayed quantity of designated object landings, (m) one or more nudges of one or more of the reels until a winning symbol combination is displayed on the reels, (n) the respinning of one or more reels until a winning symbol combination is displayed on the reels, (o) the activation of one or more additional paylines, (p) the increase of one or more per-payline award multipliers, (q) the increase in a global award multiplier, (r) the activation of one or more new line win opportunities, (s) the activation of one or more new scatter win opportunities, and (t) the rearrangement of potential ball paths (described below).

In this embodiment, the gaming system determines to modify one or more of the reels when an object lands in one of the designated object landings if a winning symbol combination is not displayed along the payline when that object lands in that designated object lending. Since, in this example, the play of the wagering game ends once a winning symbol combination is displayed along the payline, it should be appreciated that, in this embodiment, the gaming system determines to modify the reels when an object lands in one of the designated object landings as long as the wagering game is currently being played (i.e., as long as a winning symbol combination has not been displayed along the payline). It should be appreciated that the gaming system may determine whether to modify one or more of the reels in any suitable manner. In one embodiment, the gaming system determines to modify one or more of the reels when such a modification would bring the player closer to a winning symbol combination. In another embodiment, the gaming system determines to modify one or more of the reels when such a modification would bring the player closer to a jackpot winning symbol combination. In certain other embodiments, the player determines whether to modify the reels rather than the gaming system.

It should be appreciated that the object starting area may include any suitable quantity of object starting positions, that the obstacle area may include any suitable quantity of obstacles, that the obstacle area may include any suitable quantity of designated object landings, and that the obstacle ending area may include any suitable quantity of obstacle ending positions. It should also be appreciated that the object starting area may include object starting positions that are not uniform in size, that the object ending area may include object ending positions that are not uniform in size, that the obstacle area may include obstacles that are not uniform in size, and that the obstacle area may include designated object landings that are not uniform in size. It should further be appreciated that the obstacles and the designated object landings may be of any suitable shape. It should be appreciated that any suitable types of obstacles and designated object landings may be employed.

Each of pegs 140*a* through 140*cc* and each of the designated object landings 142*a* through 142*j* is associated with a set of coordinates within peg area 140. Each peg's and each designated object landing's set of coordinates defines the position at which that peg or designated object landing is displayed within peg area 140. In this embodiment, the coordinates of each of pegs 140*a* through 140*cc* and each of designated object landings 142*a* through 142*j* are equidistant from any adjacent pegs or designated object landings. For example, the coordinates of peg 140*s* are equidistant from the coordinates of pegs 140*p* and 140*r* and designated object landings 142*b* and 142*e*, each of which is adjacent to peg 140*s*. It should be appreciated that, in other embodiments, the coordinates of adjacent obstacles and adjacent designated object landings are not equidistant from one another. In other words, the distance between the coordinates of certain adjacent obstacles and certain adjacent designated object landings may vary in these embodiments.

Display device 119 also displays an award indicator or display 124, which indicates any award(s) a player has won during a play of the wagering game; a wager indicator or display 126, which indicates any wager placed by the player for a play of the wagering game; an object count indicator 127 (shown in FIGS. 4A, 4B, 4C, 4*d*, 4E, 4F, 4G, and 4H as a balls remaining indicator), which indicates the quantity of objects that have not yet been released into peg area 140; and a credit meter 128, which indicates the player's credit balance for the wagering game.

In this embodiment, for a play of the wagering game, after receiving a wager from a player the gaming system causes reels 160*a*, 160*b*, and 160*c* to spin and display symbols at symbol display areas 161*a*, 161*b*, 161*c*, 161*d*, 161*e*, 161*f*, 161*g*, 161*h*, and 161*i*. In this embodiment, the gaming system determines a designated quantity of objects that will drop into peg area 140 based on the player's wager. For example, if the player places the maximum wager, in this embodiment the player receives four objects but if the player places any other wager, the player receives three objects. For each of the designated quantity of objects, the gaming system: (a) randomly selects one of object starting positions 130*a*, 130*b*, and 130*c*; (b) displays that object at the selected object starting position; and (c) releases that object, which falls from the selected object starting position into peg area 140. When released into peg area 140, that object falls through peg area 140 and into one of designated object landings 142*a* through 142*j* or object ending position 150*a* in one of the manners described below.

More specifically, in an electro-mechanical embodiment that includes physical objects and a physical peg board including physical pegs, when the object falls from the selected object starting position, it is pulled by gravity and falls into peg area 140 until it collides with or hits one of pegs 140*a* through 140*cc* or designated object landings 142*a* through 142*j*. In a video embodiment that includes simulated objects and a simulated peg board including simulated pegs, when the object falls from the selected object starting position, it falls into peg area 140 as if pulled by gravity until it collides with or hits one of pegs 140*a* through 140*cc* or designated object landings 142*a* through 142*j*. In either embodiment, when the object collides with one of pegs 140*a* to 140*cc* or designated object landings 142*a* through 142*j* (i.e., when the outer edge of the object touches or intersects with the outer edge of one of pegs 140*a* through 140*cc* or designated object landings 142*a* through 142*j*), the object changes direction and may or may not change speed. This occurs because pegs 140*a* through 140*cc* and designated object landings 142*a* through 142*j* are, in this embodiment, immovable. According to the laws of physics, since the pegs do not move when hit by the object, the object must change direction, speed, or both. Accordingly, after falling from the selected object starting area, the object travels through peg area 140 and collides with one or more of pegs 140*a* through 140*cc* and/or designated object landings 142*a* through 142*j* until it falls into or lands in one of designated object landings 142*a* through 142*j* or object ending position 150*a* in a manner described in detail below. It should be appreciated that, in certain embodiments, the objects interact with one another in a manner similar to the way in which the objects interact with the obstacles (as described further below).

In this video embodiment including simulated objects and a simulated peg board including simulated pegs, the gaming system determines the manner in which the object falls through peg area 140. In other words, the gaming system determines at least: (a) which of pegs 140*a* through 140*cc* and/or designated object landings 142*a* through 142*j* the object will collide with while falling through peg area 140, (b) which direction the object will fall after it collides with each peg, and (c) which one of designated object landings 142*a* through 142*j* or object ending position 150*a* the object will fall into. Put differently, the gaming system determines an object path in which the object: (a) begins at the selected object starting position; (b) collides with one of more of pegs 140*a* through 140*cc* and/or designated object landings 142*a* through 142*j* while falling through peg area 140, and (c) ends at one of designated object landings 142*a* through 142*j* or object ending position 150*a*. After the gaming system determines the object path, the display device displays the object moving from the selected object starting position to each of the pegs along the determined object path and, ultimately, into the designated object landing or the object ending position at the end of the determined object path.

The gaming system determines the object path in one of a plurality of different ways. In certain embodiments, the gaming system stores every possible object path associated with each object starting position. In other words, for each object starting position, the gaming system stores each possible path through the obstacle area along which an object may move after being released from that object starting position. In one of these embodiments, after selecting an object starting position, the gaming system determines the object path by selecting one of the stored object paths associated with the selected object starting position. The gaming system then displays the object moving from the selected object starting position along the selected stored object path through the obstacle area and into the designated object landing or the object ending position at the end of the selected stored object path. In another one of these embodiments, rather than selecting an object starting position, the gaming device selects one of the stored object paths. The gaming system then displays the object moving from the object starting position at the beginning of the selected stored object path along the selected stored object path through the obstacle area and into the object ending position at the end of the selected stored object path.

In certain other embodiments, the gaming system determines the object path by dynamically generating the object path while the object is falling through the obstacle area. In these embodiments, when the object collides with an obstacle or a designated object landing the gaming system determines the direction in which the object will fall or travel after colliding with the obstacle or the designated object landing. In one of these embodiments, when the object collides with an obstacle or a designated object landing the gaming system randomly determines the direction in which the object will fall or travel. Thus, in this embodiment, there is an equal likelihood that the object will fall to the right or to the left of an obstacle or a designated object landing after a collision. In another one of these embodiments, when the object collides with an obstacle or a designated object landing the gaming system determines the direction in which the object will fall or travel based on weighted values. Therefore, in this embodiment, it is more likely that an object will fall to either the left or the right after a collision. The weighted values can be determined in any suitable manner, such as (but not limited to), based on game play, based on a player input, or randomly. In another one of these embodiments, the gaming system uses a physics engine to determine the direction in which the object will fall or travel after colliding with an obstacle or a designated object landing. In this embodiment, the physics engine may take the size and shape of the object into account when determining the direction in which the object will travel after colliding with an obstacle or a designated object landing.

It should be appreciated that the gaming system may generate the object path along which an object moves in any suitable manner.

In either embodiment, when an object lands in one of the designated object landings, the gaming system determines whether to modify (move, in this embodiment) one or more of the reels in one of the manners described above. If the gaming system determines to modify at least one of the reels, the gaming system modifies one or more of the reels 160*a*, 160*b*, and 160*c* based on which designated object landing the object fell into. If, for example, one of the objects falls into designated object landing 142*e*, the gaming system nudges reel 160*a* downward after determining to move reel 160*a*. If, for example, one of the objects falls into designated object landing 142*j*, the gaming system respins each of reels 160*a*, 160*b*, and 160*c* after determining to move reels 160*a*, 160*b*, and 160*c*. If, for example, one of the objects falls into designated object landing 142*c*, the gaming system nudges reel 160*c* upward after determining to move reel 160*c*. Conversely, in this embodiment, when one of the objects lands in object ending position 150*a* the gaming system does not modify the reels.

It should thus be appreciated that any of the above or below-described embodiments of the present disclosure may be adapted for use in: (a) an electro-mechanical gaming system or device utilizing a physical obstacle board and physical objects, and (b) a gaming system or device utilizing a simulated obstacle board and simulated objects.

Figure 4A:
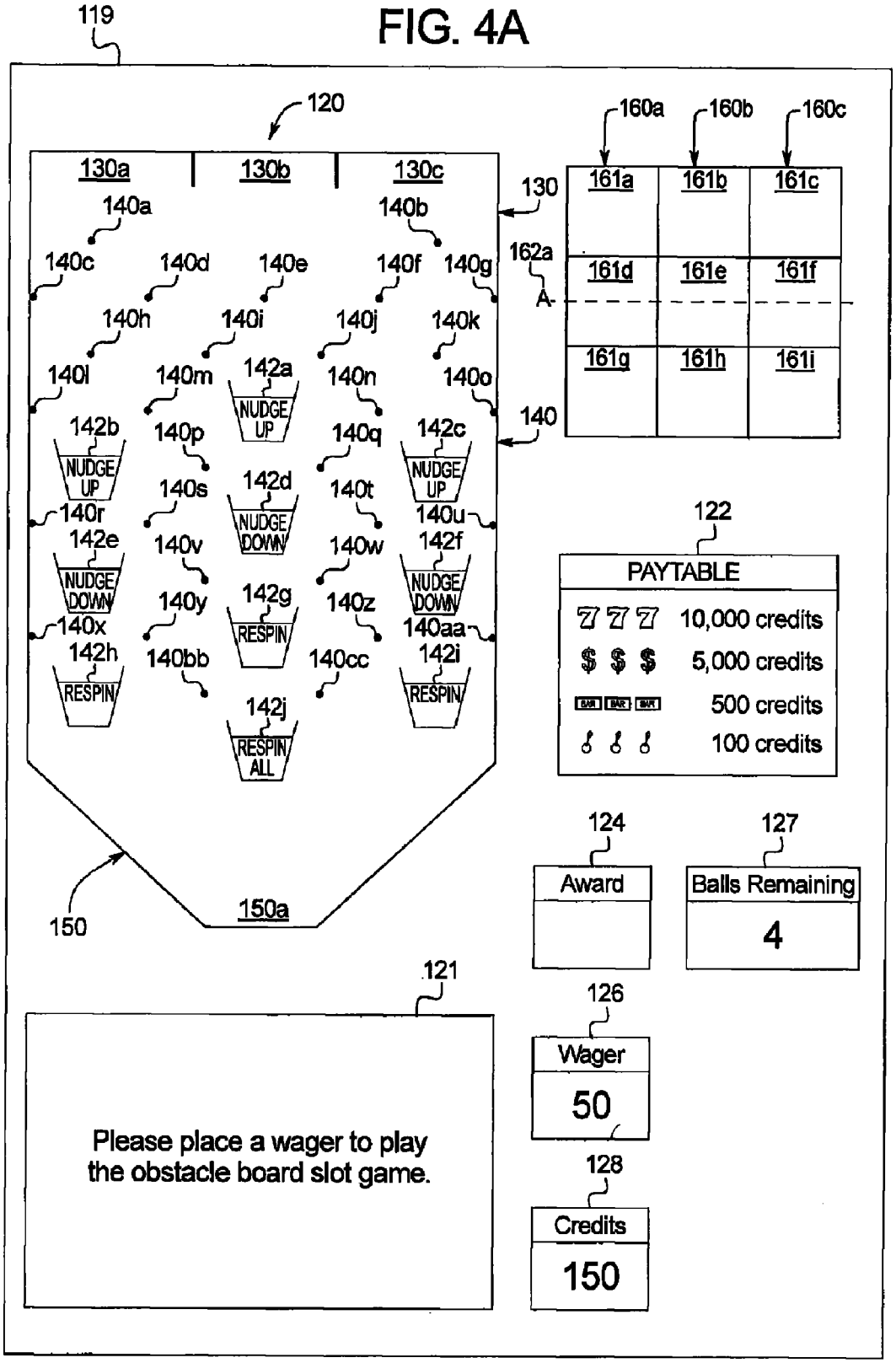
FIGS. 4A, 4B, 4C, 4D, 4E, 4F, 4G, and 4H are front views of a display device of the gaming system or gaming device of the present disclosure and illustrate a play of one embodiment of the obstacle board slot game of the present disclosure.

FIGS. 4A, 4B, 4C, 4D, 4E, 4F, 4G, and 4H illustrate an example play of one embodiment of the wagering game. As shown in FIG. 4A, when the gaming system is not being played by a player, display device 119 displays an attract screen that includes a welcome message in indication box 121. The welcome message invites a player to place a wager to play the wagering game. In this example, the player deposits 200 credits and places the maximum wager of 50 credits, which activates payline A. In this example, since the player placed the maximum wager the player receives a designated quantity of four objects, which is the maximum quantity of objects that may be provided to a player per play in this example of the wagering game (although any suitable designated quantity of objects may be provided). The player's wager is displayed in wager indicator 126, the player's quantity of four objects is displayed in object count indicator 127, and the player's credit balance of 150 credits (the player's initial 200 credit deposit minus the player's 50 credit wager) is displayed in credit meter 128.

In this example embodiment, after receiving a wager from the player and providing the player with a designated quantity of objects, the gaming system spins the reels and releases each of the designated quantity objects simultaneously or almost simultaneously from one or more of the object starting positions into the peg area. In this example, the gaming system releases all of the designated quantity objects when the reels begin spinning; that is, the gaming system does not wait for one or more of the objects to land in one of the designated object landings or the object ending position before releasing another one of the objects into the peg area. The reels stop spinning and the symbol display areas display a plurality of the symbols on the reels. If the reels display a winning symbol combination along the payline following the spin, the player is provided the award associated with the displayed winning symbol combination and the play of the wagering game ends (i.e., the designated quantity of objects and any designated object landings into which those objects fall are irrelevant in this scenario). If not, and if any of the designated quantity of objects land in the designated object landings, the gaming system determines whether to modify one or more of the reels. In this embodiment, the gaming system determines to modify the reels as long as the wagering game is still being played (i.e., as long as a winning symbol combination is not displayed along the payline), and the reels are modified according to the designated object landing(s) into which the object(s) fell. If the reels are modified such that a winning symbol combination is displayed along the payline, the player is provided the award associated with the displayed winning symbol combination and the play of the wagering game ends. For clarity, FIGS. 4A, 4B, 4C, 4D, 4E, 4F, 4G, and 4H illustrate various stages of the wagering game separately, though it should be appreciated that, in this embodiment, they occur simultaneously or substantially simultaneously as described above.

Figure 4B:
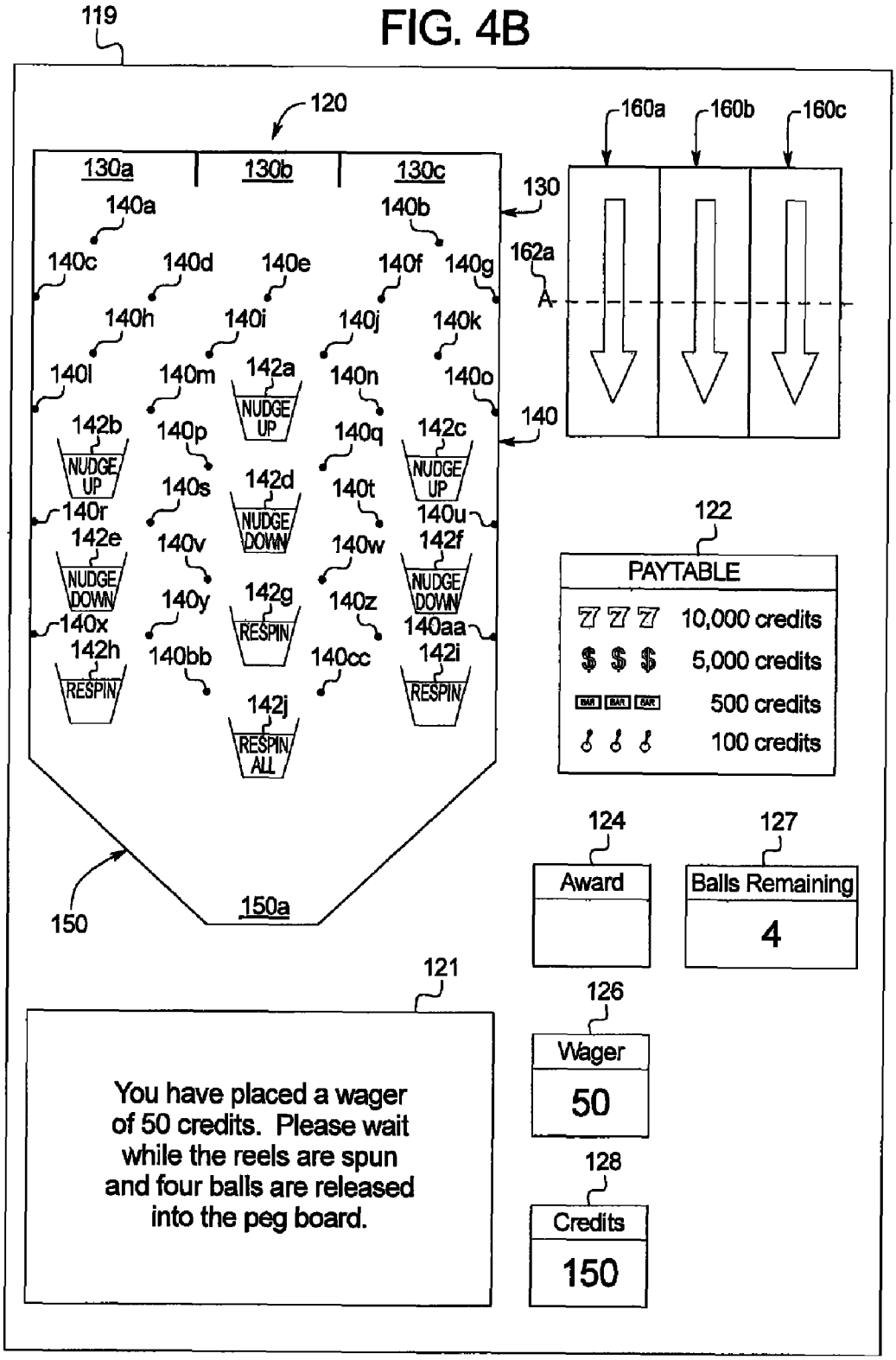

As illustrated in FIG. 4B, indication box 121 displays an instruction to the player to wait while the gaming system spins the reels. The gaming system also notifies the player that the designated quantity of four objects will be released from the object starting positions into the peg area when the reels begin spinning.

Figure 4C:
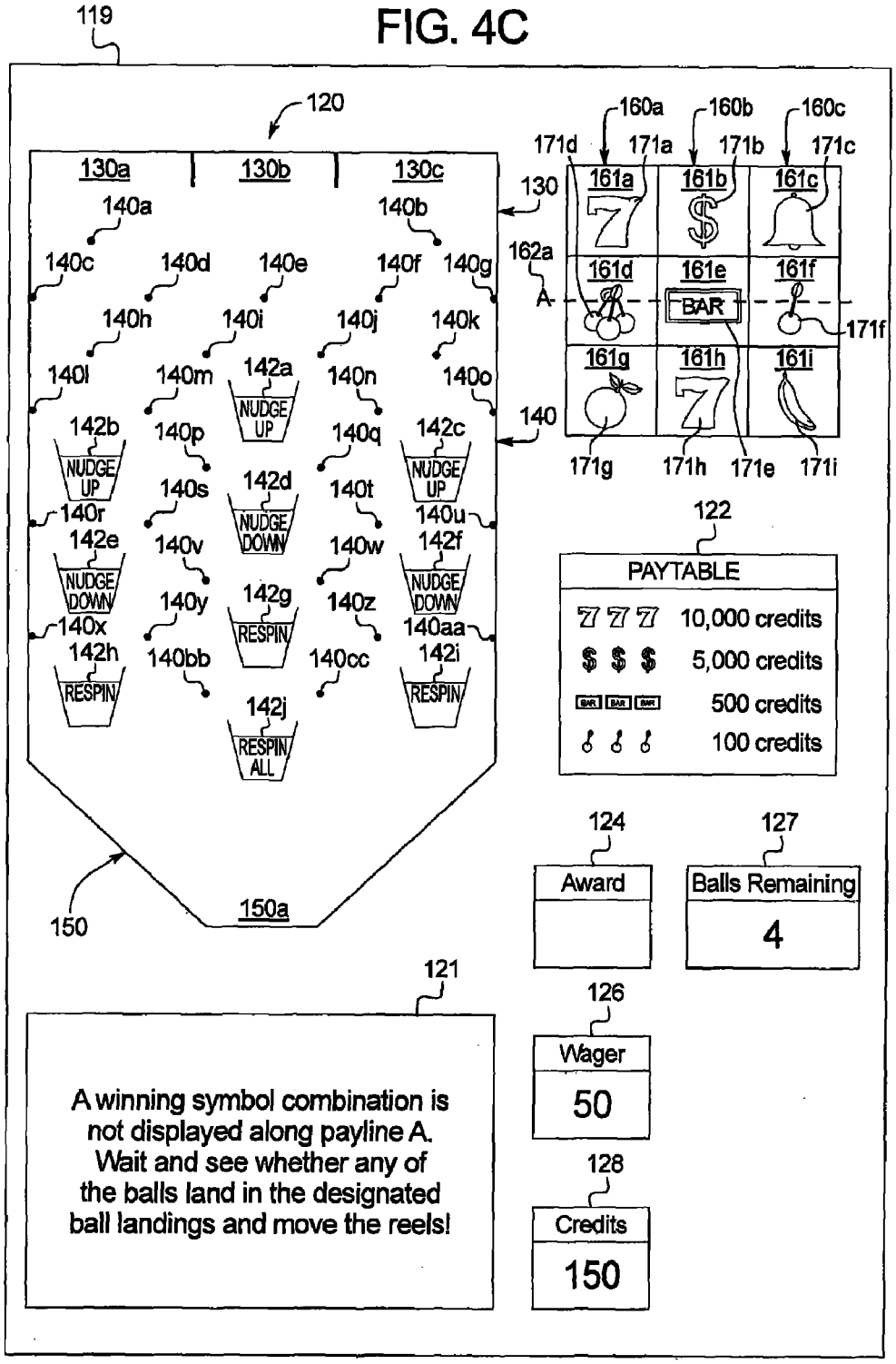

As illustrated in FIG. 4C, gaming system causes reels 160*a*, 160*b*, and 160*c* to spin and display symbols 171*a*, 171*b*, 171*c*, 171*d*, 171*e*, 171*f*, 171*g*, 171*h*, and 171*i* at symbol display areas 161*a*, 161*b*, 161*c*, 161*d*, 161*e*, 161*f*, 161*g*, 161*h*, and 161*i*, respectively. Payline A is not associated with a winning symbol combination at this point.

Figure 4D:
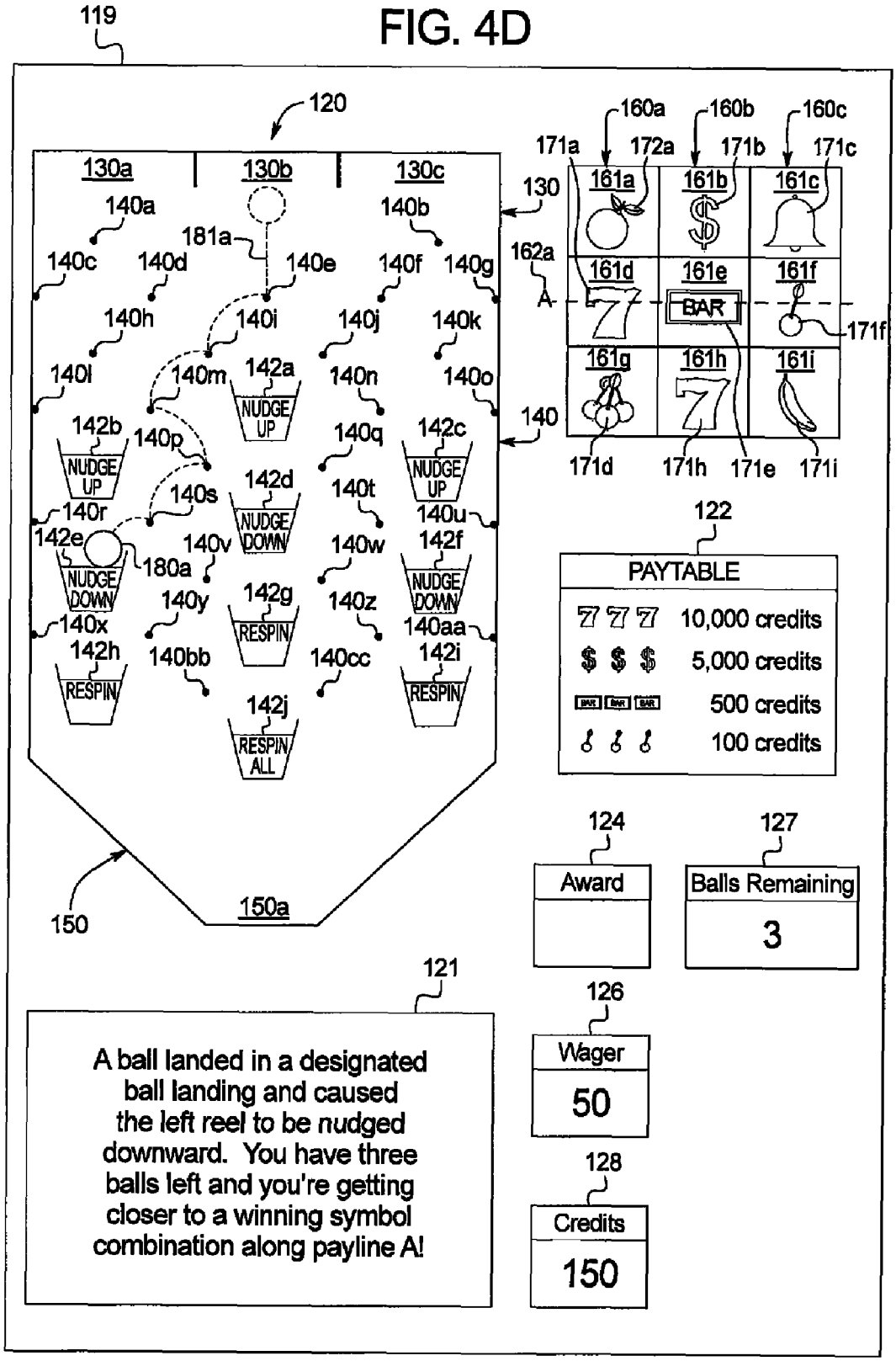

When the reels begin spinning, the gaming system releases the designated quantity of four objects into the peg area. Each of the designated quantity of objects is described individually as follows. As illustrated in FIG. 4D, the gaming system randomly selects object starting position 130*b* and displays a first object 180*a* at object starting position 130*b*. The gaming system determines (using one of the manners described above) an object path 181*a* along which first object 180*a* will fall. The gaming system displays first object 180*a* falling through peg area 140 along determined symbol path 181*a* as follows: first object 180*a* falls from object starting position 130*b* and collides with peg 140*e*, first object 180*a* falls to the left of peg 140*e* and collides with peg 140*i*, first object 180*a* falls to the left of peg 140*i* and collides with peg 140*m*, first object 180*a* falls to the right of peg 140*m* and collides with peg 140*p*, first object 180*a* falls to the left of peg 140*p* and collides with peg 140*s*, and first object 180*a* falls to the left of peg 140*s* and into designated object landing 142*e*. Since first object 180*a* landed in designated object landing 142*e*, the gaming system determines whether to modify the reel or reels associated with designated object landing 142*e* using the modification associated with designated object landing 142*e*. In this example, since the wagering game is still being played (i.e., since a winning symbol combination is not displayed along payline A), reel 160*a* is modified as described above. Specifically, reel 160*a* is nudged downward as follows: symbol 171*g* is removed from symbol display area 161*g*, symbol 171*d* moves to symbol display area 161*g*, symbol 171*a* moves to symbol display area 161*d*, and new symbol 172*a* is displayed in symbol display area 161*a*. Indication box 121 displays a notification that first object 180*a* landed in designated object landing 142*e* and that reel 160*a* was nudged downward. Since (a) no winning symbol combination is displayed along payline A, and (b) three of the designated quantity of objects remain in play, the play of the wagering game continues.

In this embodiment, once one of the objects has landed in (i.e., is displayed at) one of the designated object landings, that object remains displayed at that designated object landing for the duration of the play of the obstacle board slot game. In other words, for each designated object landing, the first object to occupy (i.e., be displayed at) that designated object landing will not be removed from that designated object landing until the play of the wagering game is complete. When one of the objects lands in an object ending position that is already occupied by another one of the objects, the gaming system determines not to further modify any of the reels in accordance with that designated object landing, and the later-landing object is removed from play. The earlier-landing object remains displayed at the designated object landing. It should therefore be appreciated that, in this embodiment, the modification associated with each designated object landing may only be performed once for each play of the wagering game (i.e., the gaming system determines to modify the reels in association with any of the designated object landings one time). For example, once an object lands in designated object landing 142*h* and reel 160*a* is respun accordingly, any subsequent designated object landing in designated object landing 142*h* does not cause reel 160*a* to respin (i.e., the gaming system determines not to modify reel 160*a*). In other words, once an object lands in one of the designated object landings, that designated object landing is deactivated for the remainder of the play of the wagering game in various embodiments.

Figure 4E:
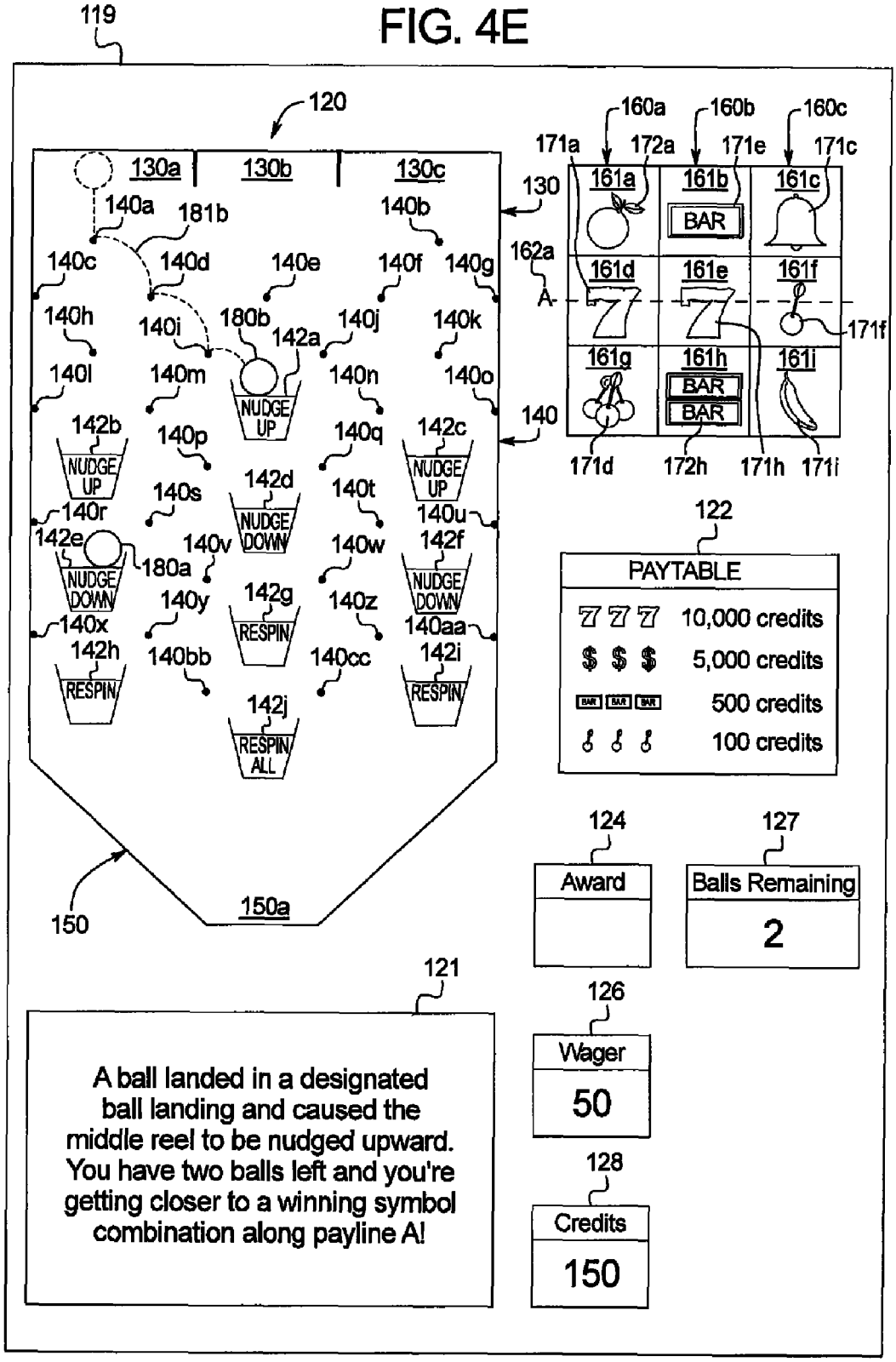

As illustrated in FIG. 4E, the gaming system randomly selects object starting position 130*a* and displays a second object 180*b* at object starting position 130*a*. The gaming system determines an object path 181*b* along which second object 180*b* will fall. The gaming system displays second object 180*b* falling through peg area 140 along determined symbol path 181*b* as follows: second object 180*b* falls from object starting position 130*a* and collides with peg 140*a*, second object 180*b* falls to the right of peg 140*a* and collides with peg 140*d*, second object 180*b* falls to the right of peg 140*d* and collides with peg 140*i*, and second object 180*b* falls to the right of peg 140*i* and into designated object landing 142*a*. Since second object 180*b* landed in designated object landing 142*a*, the gaming system determines whether to modify the reel or reels associated with designated object landing 142*a* using the modification associated with designated object landing 142*a*. In this example, since the wagering game is still being played (i.e., since a winning symbol combination is not displayed along payline A), reel 160*b* is modified as described above. Specifically, reel 160*b* is nudged upward as follows: symbol 171*b* is removed from symbol display area 161*b*, symbol 171*e* moves to symbol display area 161*b*, symbol 171*h* moves to symbol display area 161*e*, and new symbol 172*h* is displayed in symbol display area 161*h*. Indication box 121 displays a notification that second object 180*b* landed in designated object landing 142*a* and that reel 160*b* was nudged upward. Since (a) no winning symbol combination is displayed along payline A, and (b) two of the designated quantity of objects remain in play, the play of the wagering game continues.

Figure 4F:
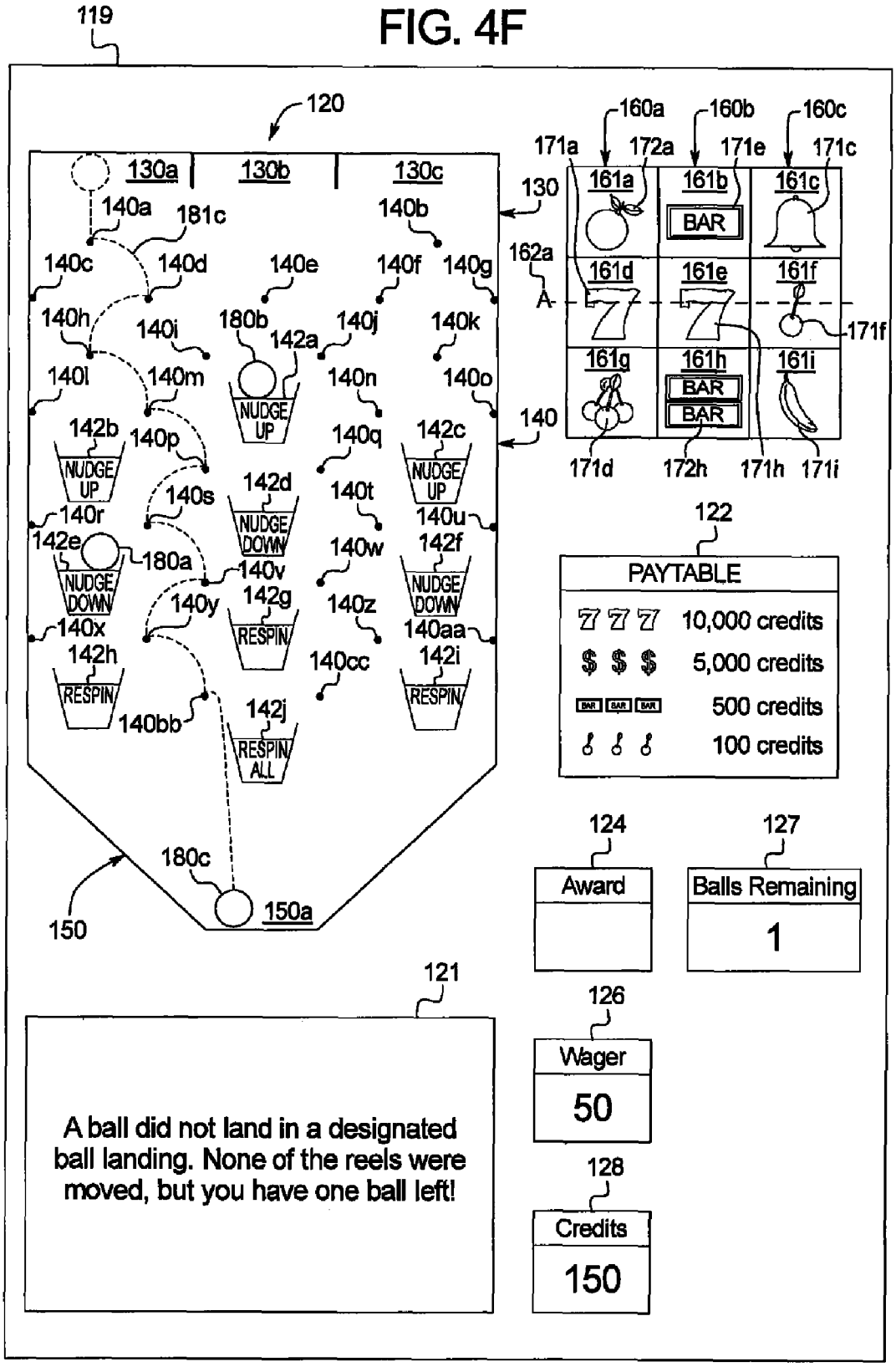

As illustrated in FIG. 4F, the gaming system randomly selects object starting position 130*a* and displays a third object 180*c* at object starting position 130*a*. The gaming system determines an object path 181*c* along which third object 180*c* will fall. The gaming system displays third object 180*c* falling through peg area 140 along determined symbol path 181*c* as follows: third object 180*c* falls from object starting position 130*a* and collides with peg 140*a*, third object 180*c* falls to the right of peg 140*a* and collides with peg 140*d*, third object 180*c* falls to the left of peg 140*d* and collides with peg 140*h*, third object 180*c* falls to the right of peg 140*h* and collides with peg 140*m*, third object 180*c* falls to the right of peg 140*m* and collides with peg 140*p*, third object 180*c* falls to the left of peg 140*p* and collides with peg 140*s*, third object 180*c* falls to the right of peg 140*s* and collides with peg 140*v*, third object 180*c* falls to the left of peg 140*v* and collides with peg 140*y*, third object 180*c* falls to the right of peg 140*y* and collides with peg 140*bb*, and third object 180*c* falls to the right of peg 140*bb* and into object ending position 150*a*. Since third object 180*c* landed in object ending position 150*a*, none of the reels are modified in this embodiment. Indication box 121 displays a notification that third object 180*c* landed in object ending position 150*a* and that no reels were modified. Since (a) no winning symbol combination is displayed along payline A, and (b) one of the designated quantity of objects remains in play, the play of the wagering game continues. While, in this embodiment, there is no modification associated with a designated object landing in object ending position 150*a*, it should be appreciated that in certain embodiments there is a modification associated with a designated object landing on one of the object ending positions.

Figure 4G:
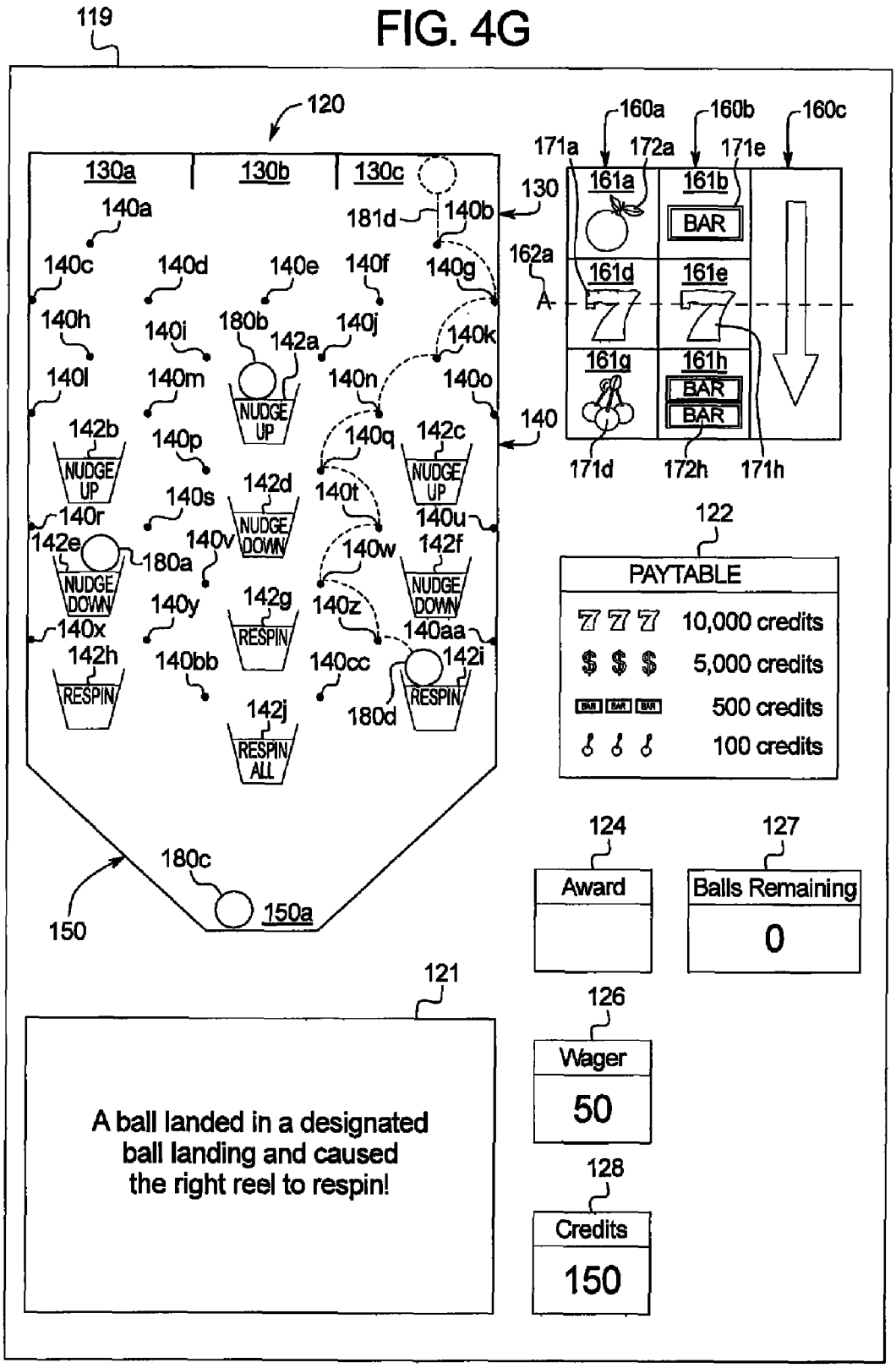

As illustrated in FIG. 4G, the gaming system randomly selects object starting position 130*c* and displays a fourth object 180*d* at object starting position 130*c*. The gaming system determines an object path 181*d* along which fourth object 180*d* will fall. The gaming system displays fourth object 180*d* falling through peg area 140 along determined symbol path 181*d* as follows: fourth object 180*d* falls from object starting position 130*c* and collides with peg 140*b*, fourth object 180*d* falls to the right of peg 140*b* and collides with peg 140*g*, fourth object 180*d* falls to the left of peg 140*g* and collides with peg 140*k*, fourth object 180*d* falls to the left of peg 140*k* and collides with peg 140*n*, fourth object 180*d* falls to the left of peg 140*n* and collides with peg 140*q*, fourth object 180*d* falls to the right of peg 140*q* and collides with peg 140*t*, fourth object 180*d* falls to the left of peg 140*t* and collides with peg 140*w*, fourth object 180*d* falls to the right of peg 140*w* and collides with peg 140*z*, and fourth object 180*d* falls to the right of peg 140*z* and into designated object landing 142*i*. Since fourth object 180*d* landed in designated object landing 142*i*, the gaming system determines whether to modify the reel or reels associated with designated object landing 142*i* using the modification associated with designated object landing 142*i*. In this example, since the wagering game is still being played (i.e., since a winning symbol combination is not displayed along payline A), reel 160*c* is modified as described above. Specifically, the gaming system causes reel 160*c* to respin such that symbols on reel 160*c* are displayed at symbol display areas 161*c*, 161*f*, and 161*i*.

Figure 4H:
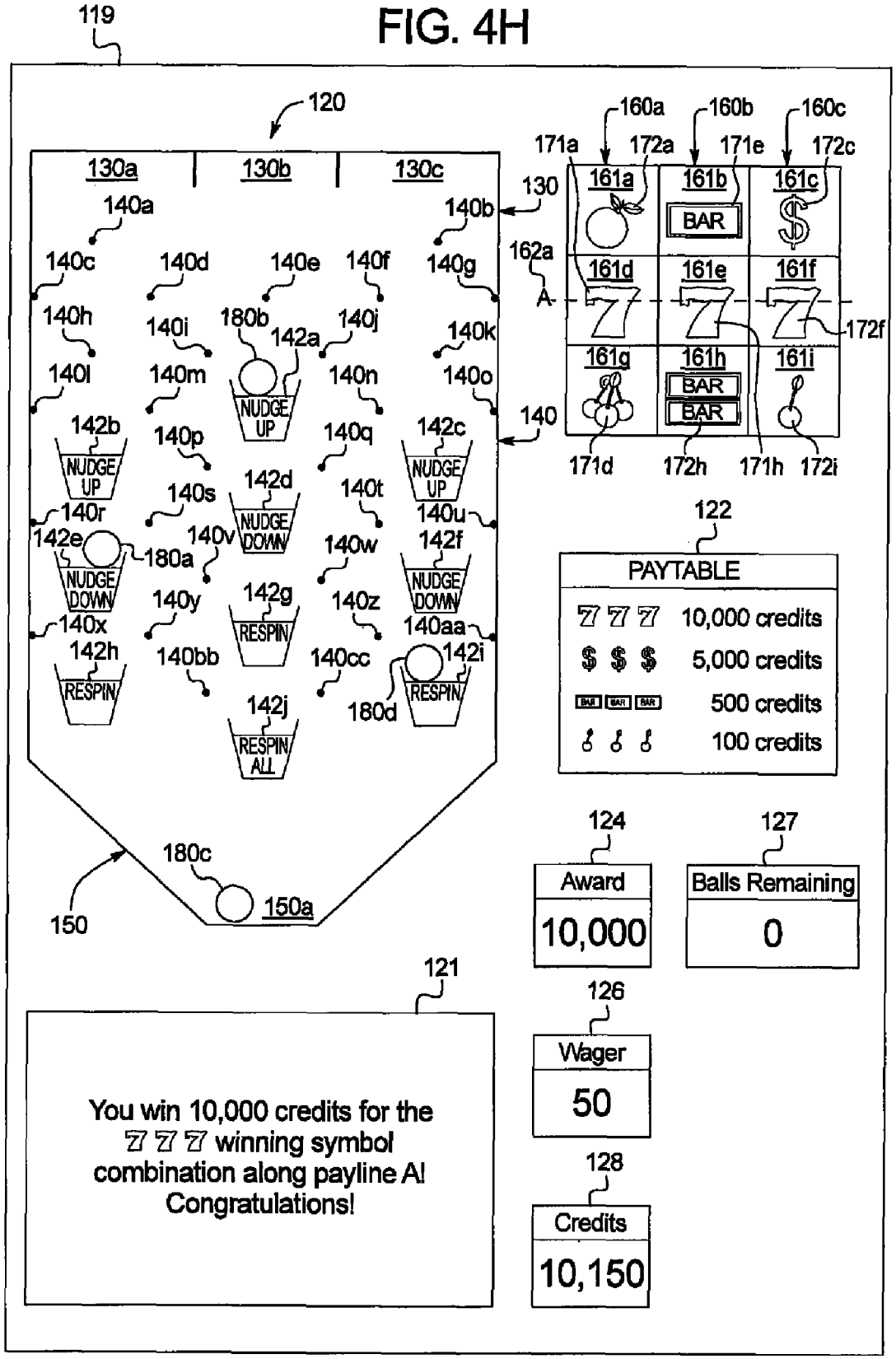

As illustrated in FIG. 4H, reel 160*c* was respun and stopped such that symbol 172*c* is displayed at symbol display area 161*c*, symbol 172*f* is displayed at symbol display area 162*f*, and symbol 172*i* is displayed at symbol display area 162*i*. A winning symbol combination is displayed along payline A. Specifically, symbol display areas 161*d*, 161*e*, and 161*f* along payline A each display SEVEN symbols 171*a*, 171*h*, and 172*f*, respectively. As indicated in paytable 122, the player wins an award of 10,000 credits for the displayed SEVEN-SEVEN-SEVEN winning symbol combination, and the award is displayed in award indicator 124. The player's credit balance displayed in credit meter 128 increases to 10,150 credits, which reflects the player's initial credit balance of 200 credits minus the player's wager of 50 credits plus the player's award of 10,000 credits. Since a winning symbol combination is displayed along payline A (and since none of the designated quantity of objects remain in play), the play of the wagering game ends.

While the embodiment of the gaming system described above with respect to FIGS. 4A, 4B, 4C, 4D, 4E, 4F, 4G, and 4H begins releasing objects into the obstacle area at the same time the gaming system begins spinning the reels, it should be appreciated that objects may be released into the obstacle area at any suitable time. In certain embodiments, the gaming system begins releasing objects into the obstacle area after the reels stop spinning. In these embodiments, the player is able to see which nudges or respins (if any) would bring the player closer to a winning symbol combination and, therefore, which of the designated object landings would be beneficial to the player if an object was to land in those designated object landings. In certain other embodiments, the gaming system begins releasing objects into the obstacle area while the reels are spinning. In certain of these embodiments, the gaming system is configured to begin releasing objects into the obstacle area such that the reels stop spinning prior to any of the objects landing in any of the designated object landings or object ending positions. In certain embodiments, the gaming system begins releasing objects into the obstacle area before the reels start spinning. It should be appreciated that, in various embodiments, the gaming system begins releasing objects into the obstacle area one or more of before the reels start spinning, while the reels are spinning, and after the reels stop spinning.

While the embodiment of the gaming system described above with respect to FIGS. 4A, 4B, 4C, 4D, 4E, 4F, 4G, and 4H simultaneously or substantially simultaneously releases objects into the obstacle area, it should be appreciated that objects may be released into the obstacle area in any suitable manner. In certain embodiments, objects are released into the obstacle board slot game area sequentially, i.e., one at a time. In one of these embodiments, objects may be released a predetermined time period (such as one second) apart. In another of these embodiments, a subsequent object is not released until the preceding object has landed in a designated object landing or an object ending position. In certain other embodiments, a plurality, but not all, of the objects are released simultaneously or substantially simultaneously.

It should be appreciated that, in certain embodiments, a player may actively control one or more of: (a) for each of one, a plurality of, or all of the designated quantity of objects, when that object is released into the obstacle board slot game area; (b) how many of the designated quantity of objects are released into the obstacle board slot game area; and (c) for each of one, a plurality of, or all of the designated quantity of objects, which object starting position that object is released from. In one example embodiment, the gaming system enables the player to choose, for each of the designated quantity of objects, which object starting position that object is released from. This enables the player to target certain designated object landings that the player knows or believes will help the player achieve a winning outcome with a certain nudge, respin, or other modification.

It should be appreciated that the designated quantity of objects may be determined in any suitable manner. In one embodiment, the designated quantity of objects is predetermined. In various embodiments, the designated quantity of objects is determined: (a) randomly, (b) based on one or more wagers placed by a player, (c) based on one or more additional fees or payments made by a player, (d) based on one or more aspects of game play, (e) based on information stored in a player tracking profile, or (f) any suitable combination thereof.

It should be appreciated that the gaming system may select the object starting position from which an object will fall in any suitable manner. In one embodiment, the gaming system enables the player to select the object starting position from which the object will fall. In another embodiment, the gaming system selects the object starting position from which the object will fall based on a predetermined order. For example, the gaming system may cause the first object to fall from the leftmost object starting position, the second object to fall from the object starting position directly to the right of the leftmost object starting position, and so on. In another embodiment wherein the obstacle board slot game is a secondary or bonus game associated with a primary or base game, the gaming system selects the object starting position from which the object will fall based on one or more outcomes of the primary or base game.

In certain embodiments, if no winning symbol combination is displayed along any payline after the reels have spun and all of the designated quantity of objects have fallen through the obstacle area and into one of the designated object landings or the object ending positions, the gaming system enables the player to purchase additional objects. For example, the gaming system enables the player to pay a fee equal to the player's wager to purchase a certain quantity of additional objects. These objects are then released into the obstacle area in one or more of the manners described above. If any of the additional objects land in any of the designated object landing areas that modify the reels such that a winning symbol combination is displayed along one or more paylines, the player is provided with the associated award and the wagering game ends. In another example, the gaming system requires the player to place an additional wager (such as doubling the player's initial wager) for an additional quantity of objects. In certain embodiments, the gaming system enables the player to use player tracking points accumulated by the player to purchase an additional quantity of objects. These embodiments thus enable a player who achieves a symbol combination that is close to a winning symbol combination along one of the paylines to continue playing to attempt to achieve a nudge, respin, or other modification that could aid the player in achieving that winning symbol combination.

In certain embodiments, the gaming system enables the player to purchase an additional object or objects to add to the designated quantity of objects before or during play of the wagering game. In one example, the gaming system enables the player to purchase an "add-on" of a certain quantity of objects prior to releasing the objects into the obstacle area. The player may do so in any suitable manner, such as by placing an additional wager, by paying a fee, or by paying a certain quantity of player tracking points. In another example, the gaming system enables the player to purchase an "add-on" of a certain quantity of objects while the objects are being released. If, for example, the player sees that the quantity of objects remaining will not provide enough modifications of the reels to result in a winning symbol combination, the player may pay an additional fee, place an additional wager, or pay a certain quantity of player tracking points to obtain additional objects to release into the object area. In some embodiments, the fee varies relative to the outcome. It should be appreciated that any suitable quantity of additional objects may be provided to the player before, during, or after the designated quantity of objects are released into the object area. It should also be appreciated that the additional objects may be purchased in any suitable manner.

In certain embodiments, the gaming system includes non-designated target areas such as non-designated ball landings in addition to the designated target areas. In these embodiments, the non-designated target areas do not cause the gaming system to modify the reels when an object moves into the non-designated target areas. In some of these embodiments, non-designated target areas may be converted into designated target areas upon the occurrence of a designated triggering event, such as a player wagering a certain amount. In other of these embodiments, designated target areas may be converted into non-designated target areas upon the occurrence of the same or a different triggering event.

In certain embodiments, the gaming system enables the player to respin one or more of the reels once (or, in certain embodiments, a plurality of times) during play of the wagering game without placing an additional wager or paying a fee. In other words, the gaming system provides the player with one (or a plurality of) free respins for each play of the wagering game. This enables the player to, upon seeing the outcome of the initial reel spin, respin the reels if the outcome is not favorable. For example, if the outcome of the initial reel spin does not include any symbol combinations that are close to any of the winning symbol combinations (meaning that one or more nudges, respins, or other modifications may not help the player achieve a winning symbol combination), the player may use the free respin to attempt to generate a set of symbols that includes a winning symbol combination or a symbol combination that is close to a winning symbol combination. In one embodiment, the gaming system automatically uses the player's free respin if the outcome of the initial reel spin does not include any symbol combinations that are close to any winning symbol combinations. This embodiment is configured to eliminate any delay caused by a player's potential inability to immediately recognize that the displayed symbols are not close to becoming a winning symbol combination through one or more modifications.

In other embodiments, the gaming system respins the reels after a winning symbol combination is displayed along one or more of the paylines and the player is provided with any associated awards. This enables a player to potentially achieve multiple winning symbol combinations and, therefore, multiple awards for a single play of the wagering game. For example, if the reels spin, the objects are released, and the reels indicate a winning symbol combination, the reels are respun while the objects are still falling through the obstacle area. The outcome of the subsequent spin may be modified (if necessary) by one or more of the objects landing in one or more of the designated object landings, and another winning symbol combination may be achieved by the modification(s). In these embodiments, since the play of the wagering game is not complete until all of the objects have fallen through the obstacle area and into one of the designated object landings or one of the ball ending positions, the gaming system determines to modify the reels until all of the objects have fallen (i.e. until the play of the wagering game ends).

In certain embodiments, the gaming system enables the player to collect the modifications associated with any designated object landings that any objects fall into. In certain of these embodiments, the gaming system enables the player to apply one or more of those modifications after the objects have fallen through the obstacle area and into the designated object landings or the object ending positions. In other words, in these example embodiments, the player determines whether to modify one or more of the reels rather than the gaming system. For example, if four objects are released into the obstacle area, two land in a "nudge up" designated object landing, and the other two land in a "nudge down" designated object landing, the gaming system enables the player to: (a) nudge two reels upward (or the same reel upward twice), and (b) nudge two reels downward (or the same reel downward twice) at the player's discretion. In other of these embodiments, the gaming system automatically applies the collected modifications in the manner that best improves the player's chance of achieving a winning symbol combination. In certain embodiments, the gaming system enables the player to save one or more of the accumulated modifications for use in a subsequent play of the wagering game.

In other embodiments, any objects that are not used (i.e., are not released in to the obstacle area) during play of the wagering game are saved or reserved for future plays of the wagering game. For example, in one of these embodiments the designated quantity of objects are released one at a time into the obstacle area such that subsequent objects are not released until the preceding object has fallen into a designated object landing or an object ending position. If, for example, a winning symbol combination is displayed after the initial spin of the reel prior to any of the designated quantity of objects being released, those objects are saved and added to any additional objects provided to the player for the next play of the wagering game. Alternatively, those objects are used instead of any additional objects that would have been provided for the next play of the game.

In one embodiment, a modification to one of the reels is only applied if that modification would aid the player in achieving a winning symbol combination. If the modification would detract from the player's ability to achieve a winning symbol combination, that modification is not applied in this embodiment. That is, in this embodiment, the gaming system determines to modify the reels when that modification would aid the player in achieving a winning symbol combination, and determines not to modify the reels when that modification would detract from the player's ability to achieve a winning symbol combination. For example, if one of the reels displays three WILD symbols (explained below), any modification to that reel would not be performed because the three WILD symbols displayed on that reel provide the player with the best opportunity of obtaining a winning symbol combination.

In another embodiment, a displayed winning symbol combination may be modified by objects landing in designated object landings if the modification would lead to a better winning symbol combination. In this embodiment, the gaming system does not provide the player with an award for a displayed winning symbol combination as soon as that winning symbol combination is displayed. Rather, as objects fall into designated object landings, the gaming system determines whether to modify the reels based on whether the modification(s) would lead to a better winning symbol combination (e.g., a higher award). If not, the player is provided with the award for the displayed winning symbol combination after each of the objects has fallen. If so, the reels are modified accordingly and the player is provided with the award associated with the better winning symbol combination created by the modification(s).

In certain embodiments, the gaming system enables the player to respin one or more of the reels once (or, in certain embodiments, a plurality of times) during play of the wagering game by placing an additional wager or paying a fee. In certain other embodiments, the gaming system enables the player to place an additional wager, pay a fee, or pay a certain quantity of player tracking points to respin the reels one or more times and release another designated quantity of objects into the obstacle area.

In certain embodiments, the reels do not initially spin unless and until one of the objects lands in a certain designated object landing. In these embodiments, once an object lands in the certain designated object landing, the reels spin such that certain of the symbols on the reels are displayed at the symbol display areas. If any of the other objects land in any of the other designated object landings, the reels are modified as described above.

In certain other embodiments, once one of the objects lands in one of the designated object landings, that object may be replaced by a later-falling object or both objects may occupy the designated object landing. It should therefore be appreciated that, in these embodiments, the modification associated with each designated object landing may be performed a plurality of times for each play of the wagering game. In this embodiment, designated object landings are not deactivated once they receive an object. Put differently, in this embodiment the gaming system's determination of whether to modify one or more of the reels is independent of the quantity of objects that have previously landed in one of the designated object landings.

In various embodiments, the quantity, location, and type of modification associated with the designated object landings is variable. For example, in certain embodiments the quantity of designated object landings, the location of one or more of the designated object landings, or the type of modification associated with the designated object landings varies based on the wager placed by the player. In certain other embodiments, the player may change one or more of: the quantity of designated object landings, the location of one or more of the designated object landings, or the type of modification associated with the designated object landings by paying an additional fee, placing an additional wager, or paying a certain quantity of player tracking points. This enables the player to configure the designated object landings in a manner that the player believes is most favorable. In certain embodiments, the gaming system enables the player to do so after the reels have spun so that the player may configure the designated object landings in a manner that is most likely to provide the player with a winning symbol combination. It should be appreciated that the quantity, location, and type of modification associated with the designated object landings may be configured in any suitable manner.

In certain embodiments, the plurality of symbols includes a WILD symbol. In one of these embodiments, the WILD symbol takes the form of the symbol that would provide the player with the greatest possible award. In other embodiments, a winning outcome that includes the WILD symbol causes the award associated with that outcome to be increased above the award associated with an equivalent outcome that does not include the WILD symbol. In one of these embodiments, the inclusion of the WILD symbol in a winning symbol combination increases the award value associated with the winning symbol combination by a predetermined multiplier value. In another one of these embodiments, the inclusion of the WILD symbol in a winning symbol combination increases the award value associated with the winning symbol combination by a variable multiplier value. In one embodiment, the variable multiplier value is determined by an outcome of a secondary or bonus game or in any other suitable manner. In certain embodiments, the inclusion of two or more WILD symbols in a winning symbol combination increases the award value associated with the winning symbol combination by a larger amount that an equivalent outcome that includes a lesser quantity of WILD symbols.

In one embodiment in which the symbols include the WILD symbol, at least one of the bonus landings, after receiving an object, causes the gaming system to lock any displayed WILD symbols in their respective symbol display areas until a winning symbol combination is displayed. For example, the gaming system may continuously cause objects to fall until the reels are modified such that a winning symbol combination is displayed and the player wins an award.

In certain other embodiments, the plurality of symbols includes a BONUS symbol. In one of these embodiments, the BONUS symbol acts in the same manner as the WILD symbol (discussed above) and also provides the player with one or more free plays of the obstacle board slot game or a secondary or bonus game. The secondary or bonus game may be any suitable game. In another embodiment, when the BONUS symbol is generated in one of the symbol display areas along a payline, any awards associated with that payline are modified in some manner. In one of these embodiments, the modification is an increase of any award, such as by a multiplier.

In certain embodiments, the object starting area includes a single object starting position rather than a plurality of object starting positions. In one of these embodiments, the object starting position is movable. In another one of these embodiments, the movement of the object starting position and the control of objects dropping from the object starting position is controlled solely by the gaming system. In another one of these embodiments, the movement of the object starting position and/or the control of objects dropping from the object starting position may be at least partially controlled by a player.

In another embodiment, at least one of the object ending positions is floorless. When an object falls through the obstacle area along an object path into one of the floorless object ending positions, that object disappears or is otherwise removed from that object ending position (and the obstacle board game area). Accordingly, the floorless object ending positions do not display the objects that fall through the floors or otherwise disappear.

In certain embodiments, at least one of the obstacles or designated object landings has a flipper associated with it (attached thereto, for example) that may interact with a falling object. Specifically, the flipper may influence how the object falls through the obstacle area. In one embodiment, when the object contacts the flipper, the flipper forces the object to fall in a certain direction (e.g., up, down, left, or right). In one embodiment, the flipper is stationary and the way in which the flipper affects the object is based upon the manner in which the object is falling when it contacts the flipper and the orientation (the angle, for example) of the flipper itself. In another embodiment, the flipper moves. In this embodiment, the movement of the flipper also affects the manner in which the object falls through the obstacle area. In one embodiment, the flipper is oriented horizontally between two obstacles, thereby preventing an object from falling between those two obstacles. In one example of this embodiment, the flipper is positioned horizontally across the opening of a designated object landing that has already received an object, thereby preventing another object from falling into that designated object landing. In one embodiment, the flipper is oriented such that is has no effect on one or more objects. In this embodiment, for example, a triggering condition may have to occur for the flipper to interact with and influence the objects. In another embodiment, each of a plurality of the obstacles has a flipper. In one embodiment, at least one of the flippers is controlled by the player. In another embodiment, the combination of a plurality of the flippers may create a dead end area from which an object cannot escape once it enters the dead end area. In one example of this embodiment, a triggering condition must occur for the object to escape the dead end area.

It should be understood that various changes and modifications to the presently preferred embodiments described herein will be apparent to those skilled in the art. Such changes and modifications may be made without departing from the spirit and scope of the present invention and without diminishing its intended advantages. It is therefore intended that such changes and modifications be covered by the appended claims.

The invention is claimed as follows:

1. A gaming system including:

at least one display device;

at least one input device;

at least one processor; and at least one memory device storing a plurality of instructions which, when executed by the at least one processor, cause the at least one processor to operate with the at least one display device and the at least one input device to:

(a) display a wagering game including:

(i) an object starting area;

(ii) an object ending area configured to receive one or more objects, the object ending area being spaced apart in relation to the object starting area;

(iii) a plurality of obstacles between the object starting area and the object ending area;

(iv) a plurality of designated target areas between the object starting area and the object ending area; and (v) a plurality of reels each including a plurality of different symbols;

(b) receive a wager from a player;

(c) cause the reels to display a plurality of the symbols;

(d) display at least one object moving from the object starting area to one of the designated target areas or the object ending area along one of a plurality of different object paths through the obstacles;

(e) if one of the objects moves into one of the designated target areas:

(i) determine whether to cause at least one of the reels to move; and (ii) if the at least one processor determines to cause at least one of the reels to move, cause said reel to move;

(f) determine whether the reels display at least one of a plurality of different predetermined winning combinations of the symbols; and (g) provide the player an award for any winning combinations of the symbols displayed on the reels.

2. The gaming system of claim 1, wherein the plurality of instructions, when executed by the at least one processor, cause the at least one processor to cause at least one of the reels to move by at least one of the group consisting of: rotating at least one of the reels upward, rotating at least one of the reels downward, and respinning at least one of the reels.

3. The gaming system of claim 1, wherein the plurality of instructions, when executed by the at least one processor, cause the at least one processor to operate with the at least one display device to display a plurality of objects moving from the object starting area to one or more of the designated target areas or the object ending area along one or more of the different object paths through the obstacles.

4. The gaming system of claim 3, wherein the plurality of instructions, when executed by the at least one processor, cause the at least one processor to operate with the at least one display device to simultaneously display said movement of two or more of the plurality of objects.

5. The gaming system of claim 1, wherein the object starting area includes a plurality of different object starting positions and each of the object paths begins at one of the object starting positions.

6. The gaming system of claim 5, wherein the plurality of instructions, when executed by the at least one processor, cause the at least one processor to operate with the at least one input device and the at least one display device to enable the player to select one of the object starting positions for the at least one object and to display the at least one object moving from the selected object starting position to one of the designated target areas or the object ending area along one of the object paths through the obstacles.

7. The gaming system of claim 1, wherein the plurality of instructions, when executed by the at least one processor, cause the at least one processor to:

(a) determine whether the reels display at least one of the winning combinations of the symbols before causing any of the reels to move; and (b) if at least one of the winning combinations of the symbols is displayed on the reels before any of the reels are moved, not cause any of the reels to move.

8. The gaming system of claim 1, wherein the plurality of instructions, when executed by the at least one processor, cause the at least one processor to provide (f) and (g) for each movement of at least one of the reels.

9. The gaming system of claim 1, wherein the plurality of instructions, when executed by the at least one processor, cause the at least one processor to provide (c) and (d) simultaneously.

10. The gaming system of claim 1, wherein the designated target areas are designated object landings configured to receive one of the objects.

11. A method of operating a gaming system, said method including:

(a) causing at least one processor to execute a plurality of instructions stored in at least one memory device to operate with at least one display device to display a wagering game including:

(i) an object starting area;

(ii) an object ending area configured to receive one or more objects, the object ending area being spaced apart in relation to the object starting area;

(iii) a plurality of obstacles between the object starting area and the object ending area;

(iv) a plurality of designated target areas between the object starting area and the object ending area; and (v) a plurality of reels each including a plurality of different symbols;

(b) causing the at least one processor to execute the plurality of instructions to operate with at least one input device to receive a wager from a player;

(c) causing the at least one processor to execute the plurality of instructions to cause the reels to display a plurality of the symbols;

(d) causing the at least one processor to execute the plurality of instructions to operate with the at least one display device to display at least one object moving from the object starting area to one of the designated target areas or the object ending area along one of a plurality of different object paths through the obstacles;

(e) if one of the objects moves into one of the designated target areas:

(i) causing the at least one processor to execute the plurality of instructions to determine whether to cause at least one of the reels to move; and (ii) if the at least one processor determines to cause at least one of the reels to move, causing the at least one processor to execute the plurality of instructions to cause said reel to move;

(f) causing the at least one processor to execute the plurality of instructions to determine whether the reels display at least one of a plurality of different predetermined winning combinations of the symbols; and (g) causing the at least one processor to execute the plurality of instructions to cause the player to be provided with an award for any winning combinations of the symbols displayed on the reels.

12. The method of claim 11, which includes causing the at least one processor to execute the plurality of instructions to cause at least one of the reels to move by at least one of the group consisting of: rotating at least one of the reels upward, rotating at least one of the reels downward, and respinning at least one of the reels.

13. The method of claim 11, which includes causing the at least one processor to execute the plurality of instructions to operate with the at least one display device to display a plurality of objects moving from the object starting area to one or more of the designated target areas or the object ending area along one or more of the different object paths through the obstacles.

14. The method of claim 13, which includes causing the at least one processor to execute the plurality of instructions to operate with the at least one display device to simultaneously display said movement of two or more of the plurality of objects.

15. The method of claim 11, wherein the object starting area includes a plurality of different object starting positions and each of the object paths begins at one of the object starting positions.

16. The method of claim 15, which includes causing the at least one processor to execute the plurality of instructions to operate with the at least one input device and the at least one display device to enable the player to select one of the object starting positions for the at least one object and to display the at least one object moving from the selected object starting position to one of the designated target areas or the object ending area along one of the object paths through the obstacles.

17. The method of claim 11, which includes causing the at least one processor to execute the plurality of instructions to:

(a) determine whether the reels display at least one of the winning combinations of the symbols before causing any of the reels to move; and (b) if at least one of the winning combinations of the symbols is displayed on the reels before any of the reels are moved, not cause any of the reels to move.

18. The method of claim 11, which includes causing the at least one processor to execute the plurality of instructions to provide (f) and (g) for each movement of at least one of the reels.

19. The method of claim 11, which includes causing the at least one processor to execute the plurality of instructions to provide (c) and (d) simultaneously.

20. The method of claim 11, wherein the designated target areas are designated object landings configured to receive one of the objects.

21. The method of claim 11, which is provided through a data network.

22. The method of claim 21, wherein the data network is the internet.

23. The method of claim 21, wherein the data network is a mobile telecommunications network.

24. A non-transitory computer readable medium including a plurality of instructions which, when executed by at least one processor, cause the at least one processor to:

(a) cause at least one display device to display a wagering game including:

(i) an object starting area;

(ii) an object ending area configured to receive one or more objects, the object ending area being spaced apart in relation to the object starting area;

(iii) a plurality of obstacles between the object starting area and the object ending area;

(iv) a plurality of designated target areas between the object starting area and the object ending area; and (v) a plurality of reels each including a plurality of different symbols;

(b) receive a wager from a player;

(c) cause the reels to display a plurality of the symbols;

(d) cause the at least one display device to display at least one object moving from the object starting area to one of the designated target areas or the object ending area along one of a plurality of different object paths through the obstacles;

(e) if one of the objects moves into one of the designated target areas:

(i) determine whether to cause at least one of the reels to move;

(ii) if the at least one processor determines to cause at least one of the reels to move, cause said reel to move;

(f) determine whether the reels display at least one of a plurality of different predetermined winning combinations of the symbols; and (g) provide the player an award for any winning combinations of the symbols displayed on the reels.

25. The non-transitory computer readable medium of claim 24, wherein the plurality of instructions, when executed by the at least one processor, cause the at least one processor to cause at least one of the reels to move by at least one of the group consisting of: rotating at least one of the reels upward, rotating at least one of the reels downward, and respinning at least one of the reels.

26. The non-transitory computer readable medium of claim 24, wherein the plurality of instructions, when executed by the at least one processor, cause the at least one processor to cause the at least one display device to display a plurality of objects moving from the object starting area to one or more of the designated target areas or the object ending area along one or more of the different object paths through the obstacles.

27. The non-transitory computer readable medium of claim 26, wherein the plurality of instructions, when executed by the at least one processor, cause the at least one processor to cause the display device to simultaneously display said movement of two or more of the plurality of objects.

28. The non-transitory computer readable medium of claim 24, wherein the object starting area includes a plurality of different object starting positions and each of the object paths begins at one of the object starting positions.

29. The non-transitory computer readable medium of claim 28, wherein the plurality of instructions, when executed by the at least one processor, cause the at least one processor to enable the player to select one of the object starting positions for the at least one object and to cause the at least one display device to display the at least one object moving from the selected object starting position to one of the designated target areas or the object ending area along one of the object paths through the obstacles.

30. The non-transitory computer readable medium of claim 24, wherein the plurality of instructions, when executed by the at least one processor, cause the at least one processor to:

(a) determine whether the reels display at least one of the winning combinations of the symbols before causing any of the reels to move; and (b) if at least one of the winning combinations of the symbols is displayed on the reels before any of the reels are moved, not cause any of the reels to move.

31. The non-transitory computer readable medium of claim 24, wherein the plurality of instructions, when executed by the at least one processor, cause the at least one processor to provide (f) and (g) for each movement of at least one of the reels.

32. The non-transitory computer readable medium of claim 24, wherein the plurality of instructions, when executed by the at least one processor, cause the at least one processor to provide (c) and (d) simultaneously.

33. The non-transitory computer readable medium of claim 24, wherein the designated target areas are designated object landings configured to receive one of the objects.

* * * * *

UNITED STATES PATENT AND TRADEMARK OFFICE

CERTIFICATE OF CORRECTION

PATENT NO. : 8,366,532 B1
APPLICATION NO. : 13/238759
DATED : February 5, 2013
INVENTOR(S) : Mark C. Nicely It is certified that error appears in the above-identified patent and that said Letters Patent is hereby corrected as shown below:

IN THE CLAIMS

In Claim 1, Column 37, Line 33, replace “one of the objects” with --the at least one object--.
In Claim 1, Column 37, Line 38, between “said” and “reel” insert --at least one--.
In Claim 2, Column 37, Line 47, replace the first instance of “of” with --selected from--.
In Claim 10, Column 38, Line 28, replace “one of the objects” with --the at least one object--.
In Claim 11, Column 38, Line 57, replace “one of the objects” with --the at least one object--.
In Claim 11, Column 38, Line 65, between “said” and “reel” insert --at least one--.
In Claim 12, Column 39, Line 9, replace the second instance of “of” with --selected from--.
In Claim 20, Column 39, Lines 57 to 58, replace “one of the objects” with --the at least one object--.
In Claim 22, Column 39, Line 62, replace “the” with --an--.
In Claim 24, Column 40, Line 21, replace “one of the objects” with --the at least one object--.
In Claim 24, Column 40, Line 26, between “said” and “reel” insert --at least one--.
In Claim 25, Column 40, Line 36, replace the second instance of “of” with --selected from--.
In Claim 33, Column 42, Line 7, replace “one of the objects” with --the at least one object--.

Signed and Sealed this
Twenty-eighth Day of May, 2013

Teresa Stanek Rea
*Acting Director of the United States Patent and Trademark Office*